US009746186B2

(12) United States Patent
Moro et al.

(10) Patent No.: US 9,746,186 B2
(45) Date of Patent: Aug. 29, 2017

(54) CONTROL DEVICE FOR GAS TAPS

(71) Applicant: ELTEK S.p.A., Casale Monferrato (Alessandria) (IT)

(72) Inventors: Marco Moro, Casale Monferrato (IT); Paolo Savini, Casale Monferrato (IT)

(73) Assignee: ELTEK S.p.A., Casale Monferrato (Alessandria) (IT)

( * ) Notice: Subject to any disclaimer, the term of this patent is extended or adjusted under 35 U.S.C. 154(b) by 277 days.

(21) Appl. No.: 14/403,888

(22) PCT Filed: May 24, 2013

(86) PCT No.: PCT/IB2013/054299
§ 371 (c)(1),
(2) Date: Nov. 25, 2014

(87) PCT Pub. No.: WO2013/175439
PCT Pub. Date: Nov. 28, 2013

(65) Prior Publication Data

US 2015/0122134 A1 May 7, 2015

(30) Foreign Application Priority Data

May 25, 2012 (IT) ..... TO2012A0457

(51) Int. Cl.
*F24C 3/12* (2006.01)
*F23N 1/00* (2006.01)
(Continued)

(52) U.S. Cl.
CPC ..... *F24C 3/12* (2013.01); *F23N 1/007* (2013.01); *F23N 5/107* (2013.01); *F23N 5/203* (2013.01)

(58) Field of Classification Search
CPC ..... F24C 3/126; F23N 5/107; F23N 5/203; H01H 19/025
(Continued)

(56) References Cited

U.S. PATENT DOCUMENTS 741,267 A * 10/1903 Neubling ..... F16K 27/045 137/270
1,518,894 A * 12/1924 Bliss ..... B61D 27/0036 236/84
(Continued)

FOREIGN PATENT DOCUMENTS

| | | |
|---|---|---|
| GB | 1 452 463 | 10/1976 |
| WO | WO 2010/134040 | 11/2010 |
| WO | WO 2011/007331 | 1/2011 |

OTHER PUBLICATIONS

International Search Report for PCT/IB2013/054299, mailed Nov. 6, 2013.
(Continued)

*Primary Examiner* — Sean Michalski
(74) *Attorney, Agent, or Firm* — Nixon & Vanderhye P.C.

(57) ABSTRACT

A control device for gas appliances comprises at least one control module (20) having a supporting structure that can be associated to a gas tap (10) and defines a housing, contained within which is at least one first part of a circuit arrangement. The control module (20) comprises a command element operable by a user for activating at least one timing function and/or a function of ignition of a gas burner. The first part of the circuit arrangement comprises control elements, electrical-interconnection elements, and detection elements (45) configured for detecting actuation of the command element and supplying corresponding signals to the control elements.
(Continued)

The circuit arrangement comprises further control and/or command elements (PSD, IS, F, LE, BC, ISC) and/or an auxiliary module (PSD).

20 Claims, 20 Drawing Sheets

(51) Int. Cl.
*F23N 5/10* (2006.01)
*F23N 5/20* (2006.01)

(58) Field of Classification Search
USPC ..... 99/332, 327, 328, 333, 337, 341
See application file for complete search history.

(56) References Cited

U.S. PATENT DOCUMENTS 2,371,351 A * 3/1945 Paille ..... F23N 1/005 137/599.16
2,910,249 A * 10/1959 Gunkel ..... F16K 31/0658 239/548
2,922,614 A * 1/1960 Nickells ..... F16K 31/0689 188/289
3,355,140 A * 11/1967 Andersen ..... F16K 1/12 251/129.01
3,750,693 A * 8/1973 Hardison ..... F16K 1/12 137/219
4,033,513 A * 7/1977 Long ..... F02D 41/32 239/499
4,197,873 A * 4/1980 Minogue ..... F16K 1/126 137/219
4,223,692 A * 9/1980 Perry ..... F16K 17/30 137/460
4,402,344 A * 9/1983 Kemmner ..... F02M 7/20 137/625.33
4,557,185 A * 12/1985 Harriman ..... F24F 13/10 126/285 B
4,643,394 A * 2/1987 Shimura ..... F23N 1/005 251/129.08
4,925,155 A * 5/1990 Carman ..... F16K 31/0655 251/117
5,069,189 A * 12/1991 Saito ..... F02M 51/0653 123/533
5,199,459 A * 4/1993 Mullally ..... F02K 9/58 137/613
6,076,803 A * 6/2000 Johnson ..... F16K 31/0655 251/129.22
6,302,341 B1 * 10/2001 Yoo ..... F02M 51/0617 137/613
6,572,077 B1 * 6/2003 Worner ..... F16K 1/443 251/129.18
2002/0029812 A1 * 3/2002 Hotta ..... F16K 1/443 137/613
2004/0069355 A1 * 4/2004 Sollier ..... F16K 31/04 137/613
2004/0149945 A1 * 8/2004 Berger ..... F16K 1/443 251/129.1
2005/0022884 A1 * 2/2005 Takeda ..... F16K 31/04 137/614.21

OTHER PUBLICATIONS

Written Opinion of the International Searching Report for PCT/IB2013/054299, mailed Nov. 6, 2013.

* cited by examiner

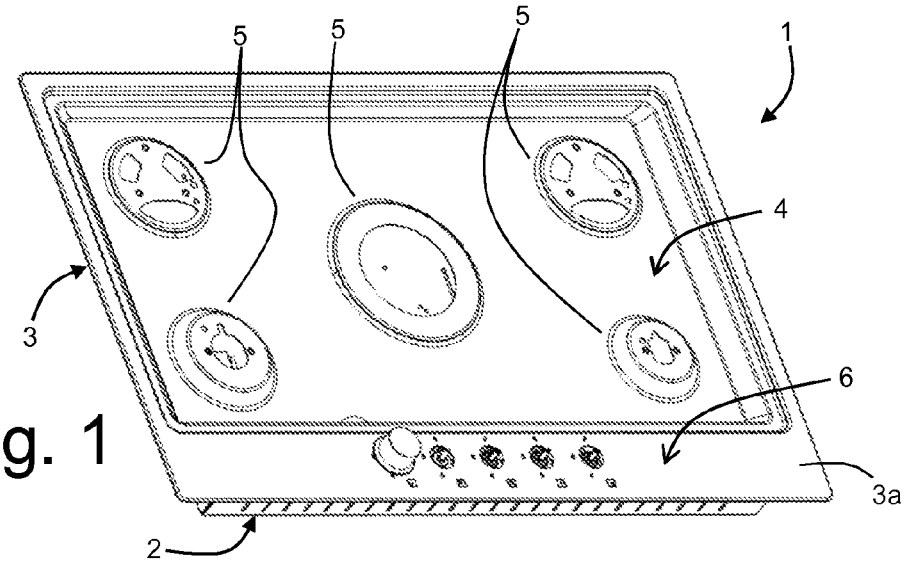
Fig. 1
Fig. 2
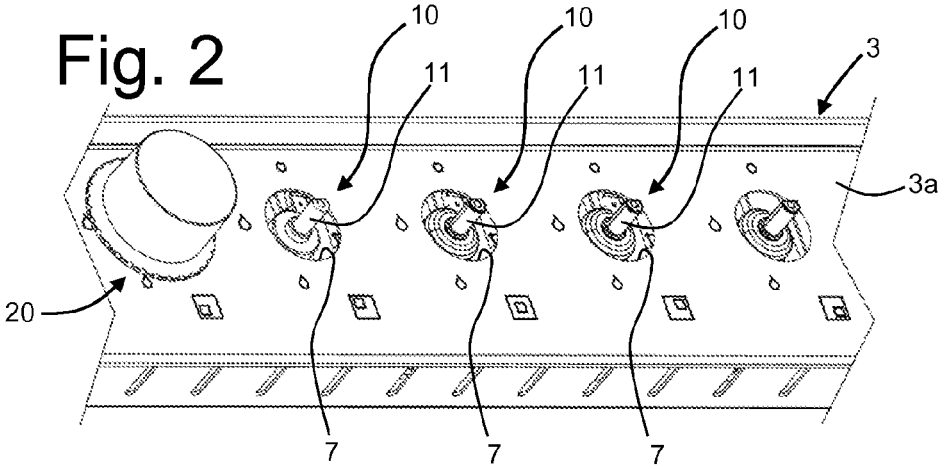
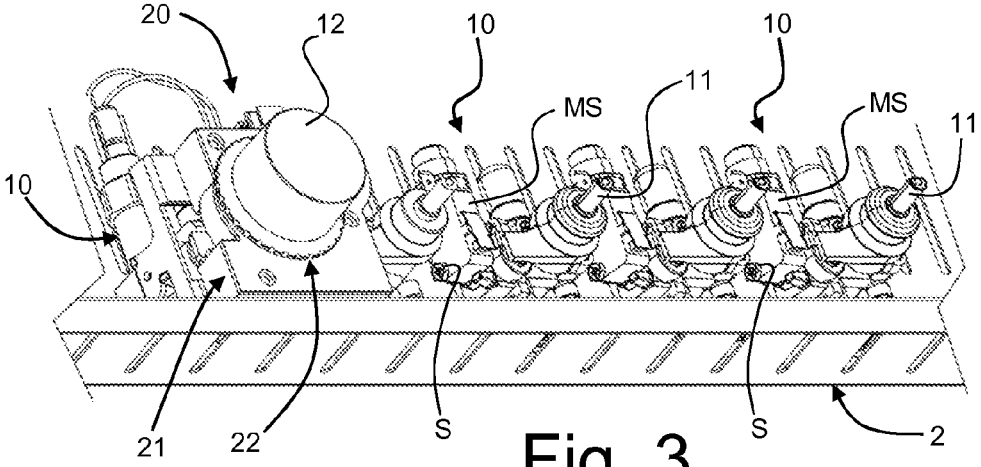
Fig. 3

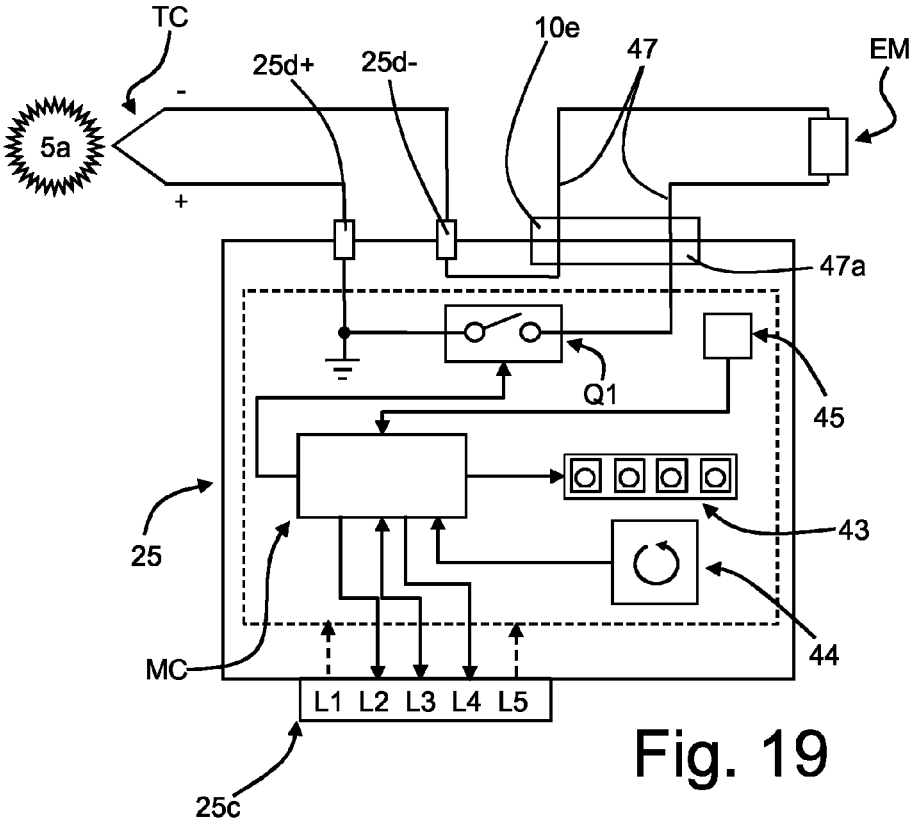
Fig. 19
Fig. 20
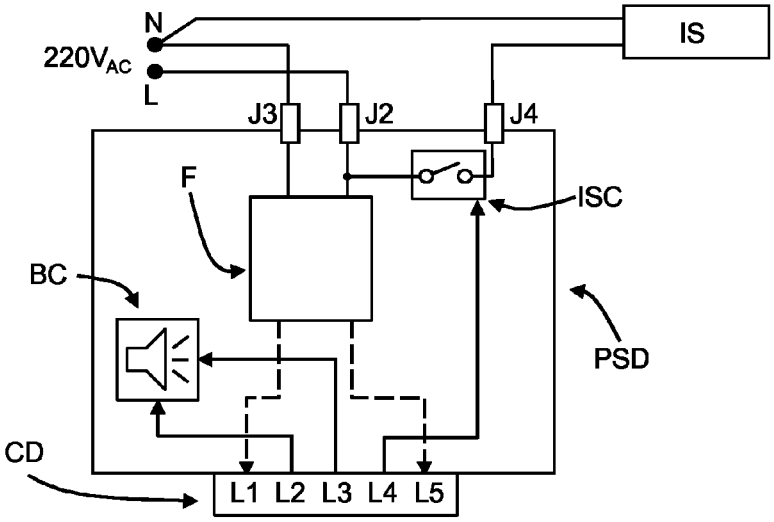

Fig. 29
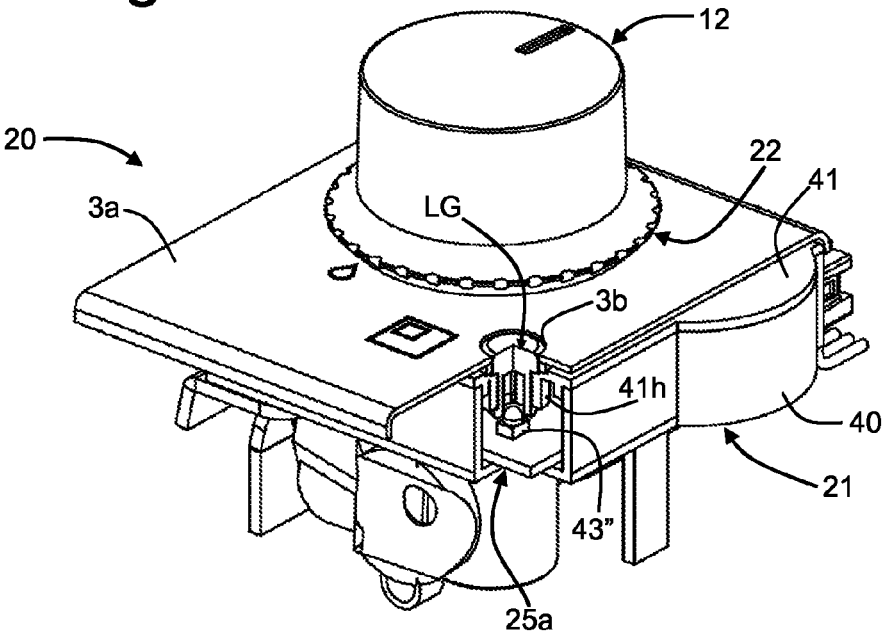
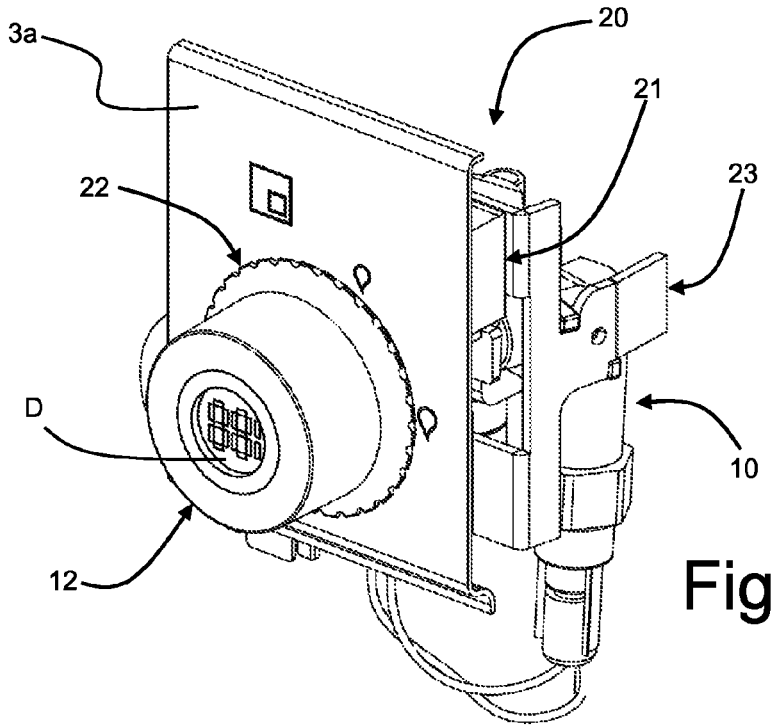
Fig. 30

CONTROL DEVICE FOR GAS TAPS

This application is the U.S. national phase of International Application No. PCT/IB2013/054299, filed 24 May 2013, which designated the U.S. and claims priority to IT Application No. TO2012A000457, filed 25 May 2012; the entire contents of each of which are hereby incorporated by reference.

FIELD OF THE INVENTION

The present invention relates to devices for control and/or detection of the supply of gas for appliances having one or more gas burners or similar flame generators. More in particular, the invention regards a control and/or detection device having a timing function, for example for enabling setting and/or adjustment and/or detection of a desired time interval of supply of gas to a respective burner or the like and/or for controlling and/or detecting the time that the burner remains lit.

PRIOR ART

Gas taps commonly used in cooking appliances and the like have a body, generally made of metal, provided with an inlet for connection to a gas-supply line, and an outlet for connection to a duct for delivery of the gas to the burner controlled by the tap. Mounted within the tap body are means for adjusting the flow of gas, constituted, for example, by an open/close element or partializer that can be position-adjusted via a manoeuvring rod and/or further levers or internal mechanisms. The rod projects axially from a proximal end of the tap body and is designed to turn about its own axis, for the purposes of the aforesaid flow adjustment. Coupled to the manoeuvring rod is a knob: a rotation imparted manually on the knob hence brings about rotation of the rod and consequent flow adjustment.

Provided within the tap body is a safety valve, which can be kept in the respective open condition by an electromagnet, the valve being of the open/closed type, for enabling or preventing, respectively, the flow of gas to the burner. The electromagnet is supplied via a thermo-electric generator, typically constituted by a thermocouple connected to a corresponding attachment or electrical connector of the tap body. The opposite end of the thermocouple, i.e., its sensitive part or hot junction, is installed in the proximity of the burner controlled by the tap. When the burner is lit, the sensitive part of the thermocouple generates an electromotive force (e.m.f.) in response to the heat generated by the flame to the burner, which determines a current that supplies the electromagnet of the safety valve, such as to keep the open/close element of the latter (associated to a movable core attracted by the electromagnet) in the respective open condition, countering the action of a spring.

Basically, as long as the burner is lit, the thermocouple generates a current that enables the electromagnet to keep the valve open; when the burner is turned off manually, or goes out accidentally, the electrical supply to the electromagnet ceases and the valve closes, forced in this direction by the aforesaid spring so as to prevent passage of gas between the inlet and the outlet of the tap.

For the aforesaid reasons, the rod of the tap is able to translate along its own axis, in a direction of actuation, against the action of elastic means inside the tap body. This axial displacement can be obtained by pushing the knob of the tap and turning it. With this movement there occurs both an initial opening of the safety valve and the flow of gas to the burner, and the knob is kept in the pressed condition until the flame is lit on the burner. As has been said, in the presence of the flame, the thermocouple generates the current, which, via the electromagnet, keeps the valve in the open condition. Hence, after ignition of the flame, the user can release the knob.

Operatively associated to the tap there may also be a gas-lighter system, for generating sparks in the proximity of the burner in order to cause ignition of the flame. This system usually comprises an electrical circuit that includes electrodes, generated between which are the aforesaid sparks following upon an electrical discharge. In some gas appliances, the lighter system is activated by exploiting the configuration of the tap, and especially the possibility of its rod translating axially. Consequently, by pressing the knob of the tap after turning it at least slightly, in addition to determining initial opening of the safety valve and flow of gas to the burner, the lighter system is also activated.

For this purpose, generally associated to the rod of the tap is an actuation element, which, in the course of axial displacement of the rod, causes switching of a microswitch of a normally open type, belonging to the electrical circuit of the lighter system. The microswitch may be of a type commonly available on the market for various uses and is anchored directly to the body of the tap, which has for this purpose at least one threaded hole for a corresponding fixing screw.

To a gas tap of the type referred to previously there may be associated a device for timed control of the supply of gas to a corresponding burner, i.e., to enable setting of a desired time interval of operation of the burner.

Timer devices are known, operatively coupled to a respective gas tap and having a corresponding knob, substantially coaxial to the knob of the tap. Via the knob of the device, a user can set a desired time interval of supply and then light the burner. Upon expiry of the time interval set, the device brings about closing of the safety valve inside the tap so as to interrupt supply of gas to the burner. For this purpose, the known device integrates a control circuit arrangement that basically includes timer means, which can be set via the corresponding knob, and controllable electrical switching means, connected between the thermocouple and the electromagnet of the safety valve of the gas tap. In a possible embodiment, the circuit arrangement of the known device also includes controllable electrical switching means connected in series to the circuit of the lighter system, designed to perform the functions of the microswitch previously referred to provided on taps of a traditional type.

SUMMARY OF THE INVENTION

In its general terms, the object of the present invention is to provide a control and/or detection device of the type indicated above, having improved structure and functions as compared to the prior art, and, in particular, a device that is intrinsically safe, compact and inexpensive to produce, easy to assemble, and of contained cost, high reliability, and convenience of use.

The above and other objects still, which will emerge more clearly hereinafter, are achieved according to the present invention by a control and/or detection device for gas appliances, in particular appliances that comprise at least one gas tap having a safety valve that includes an electromagnet that can be supplied via a thermo-electric generator, wherein the device comprises at least one control module having a supporting structure configured for installation in a position corresponding to a gas tap, in particular within a body of a gas appliance, the supporting structure defining a housing, at least in part contained within which is a corresponding first circuit arrangement. Preferably:

- the control module comprises command means, for example ones that can be operated by a user for activating at least one of a timing function and a function of ignition of a gas burner; and
- the first circuit arrangement comprises control means, first electrical-interconnection means, and detection means configured for detecting actuation of the command means and supplying corresponding signals to the control means.

The device comprises structural means and/or circuit means and/or electrical-connection means configured for improving at least one from among:

- safety of use of the device for a user;
- precision of operation;
- control of a gas-lighter system;
- visual notification of information to a user,
- acoustic notification of information to a user;
- electrical connection of the device;
- coupling of manual-control means to the detection means;
- coupling of the supporting structure of the device to the gas tap and/or to the body of the gas appliance; and
- coupling of means for actuation of the gas tap to the control device, and, in particular, to the first circuit arrangement.

Preferential characteristics of the control device according to the invention are specified in the claims, which form an integral part of the technical teaching provided herein in relation to the invention.

BRIEF DESCRIPTION OF THE DRAWINGS

Further purposes, characteristics, and advantages of the present invention will emerge clearly from the ensuing detailed description and from the annexed drawings, which are provided purely by way of explanatory and non-limiting example and in which:

FIG. 1 is a schematic perspective view of a gas-supplied appliance provided with a control device according to a possible embodiment of the invention;

FIG. 2 is a detail of FIG. 1;

FIG. 3 is a view similar to that of FIG. 2, but with a part of the appliance removed;

FIG. 19 is a simplified block diagram of a circuit arrangement of a device according to the invention, connected between a thermocouple and the electromagnet of a gas tap;

FIG. 20 is a simplified block diagram of an arrangement for supply of a device according to the invention;

FIGS. 29 and 30 are perspective views of possible variants of the invention.

DESCRIPTION OF PREFERRED EMBODIMENTS OF THE INVENTION

Figure 4:
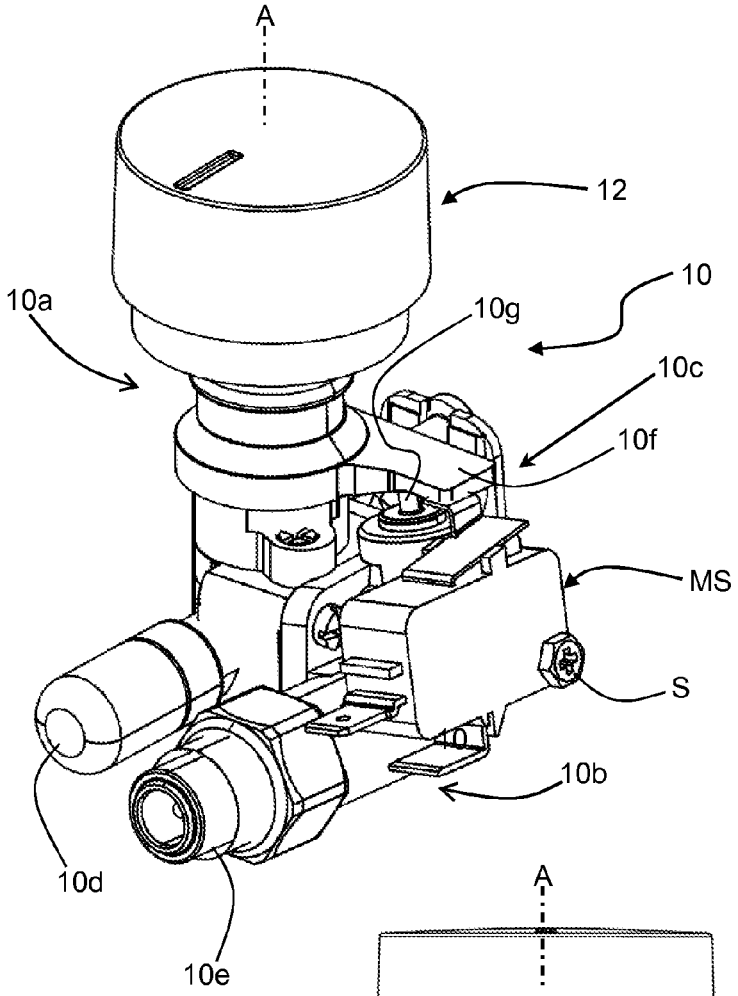
FIGS. 4 and 5 are a perspective view and a view in side elevation of a known gas tap, provided with a switch forming part of a gas-lighter system of a gas-supplied appliance.

FIG. 1 is a schematic representation of a gas-supplied appliance 1, equipped with a control device or system according to the present invention, hereinafter also defined for ready reference as "timer device".

In the example illustrated, the appliance 1 is a cooking appliance, and more in particular a cooking hob, of a general conception in itself known, of which just the elements useful for an understanding of the invention are represented. The timer device according to the invention may in any case also be used in other types of appliances provided with at least one gas burner, or similar flame generator, controlled via a respective tap, such as for example boilers, in particular for domestic heating.

The structure or body of the appliance 1 includes a lower box 2, which is fixed to an upper lid 3, defining a working area 4 identified in which are various cooking locations 5, as well as a command area 6. As per the known art, mounted within the structure of the appliance 1 are various functional components, amongst which—for what is of interest herein—taps for control of the supply of gas to the burners (not represented in detail herein)—of the various cooking locations 5. For this purpose, as may be noted in FIG. 2, a wall 3*a* of the lid 3 has—in a position corresponding to the command area 6—a series of through openings 7, projecting from each of which is the actuation rod 11 of the tap 10 of a corresponding burner. As may be appreciated from FIG. 3, the taps 10 are fixed within the structure of the appliance, in positions corresponding to the openings 7, all according to the known art. The taps 10 are of a type in itself known, in particular of the type described in the introductory part of the present description.

By way of example, in the example of embodiment represented, only one of the taps 10 is equipped with a timer device provided according to the invention, designated as a whole by 20. Once again by way of example, the four taps 10 of FIG. 3 not equipped with the device 20 are provided with traditional pushbutton microswitches, some of which are designated by MS, of the type traditionally belonging to the electrical circuit of a gas-lighter system. The microswitches MS are fixed with a screw S to the corresponding tap body.

Figure 5:
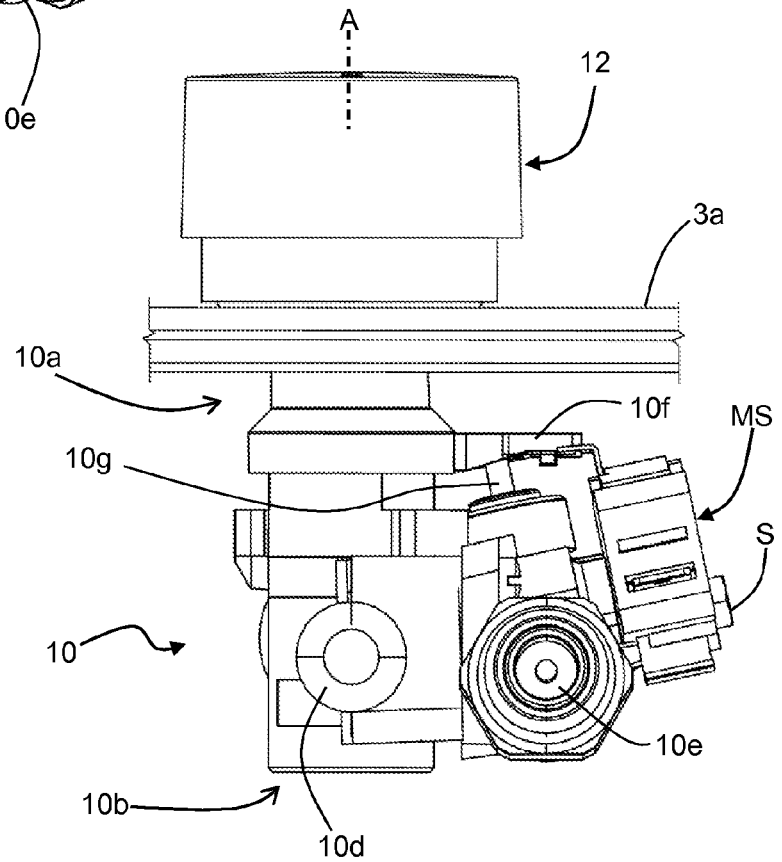

FIGS. 4 and 5 exemplify a gas tap 10 of a type generally known on the market, as described in the introductory part of the present description. In general terms, the body of the tap 10 has a front portion 10*a*, projecting from which is the corresponding rod 11—here not visible in so far as it is engaged by the corresponding control knob 12, but which extends along the axis designated by A—and a rear portion 10*b*, provided in which are the inlet and the outlet for the gas, as well as the attachment for the thermocouple, where the front portion 10*a* has overall dimensions generally small with respect to the rear portion 10*b*. In FIGS. 4 and 5 the inlet and outlet for the gas are designated by 10*c* and 10*d*, whilst the attachment for the thermocouple is designated by 10*e*. In the case of the tap 10 illustrated also visible is an actuation element 10*f*, operatively constrained to the corresponding control rod to move therewith only in an axial direction, according to a technique well known in the sector. In practice, the element 10*f* is coupled to the rod so that, when this is turned about the axis A, the element 10*f* remains substantially stationary. When, instead, the rod 11 is translated axially along the axis A, the element 10*f* follows the axial movement of the rod. With said axial movement—and in particular when the rod is pressed by means of the knob 12—the element 10*f* pushes a shaft 10*g*, which brings about opening of the safety valve of the tap 10, as explained previously, said valve being then kept open thanks to the corresponding electromagnet, once the flame of the burner has been lit. When the user releases the knob 12, the actuation element 10*f* follows the movement of axial return of the control rod.

In traditional applications, as has been said, the actuation element 10*f* can be advantageously exploited also for causing switching in closing of a microswitch MS forming part of the lighter system, which is fixed to the body of the tap via the screw S, typically a microswitch connected to the a.c. voltage of a domestic electrical wiring system, such as a 220-V a.c. voltage.

Figure 6:
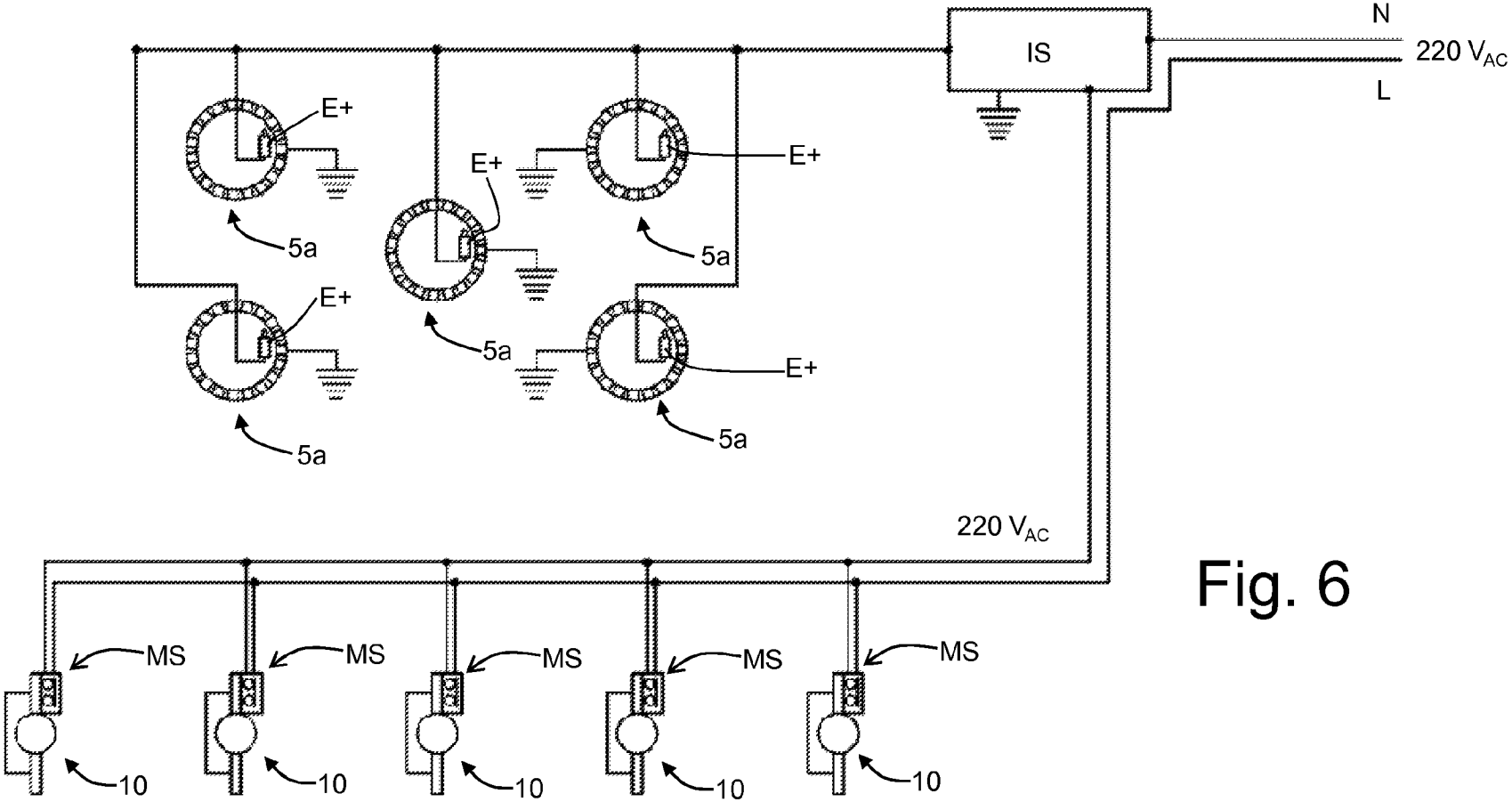
FIG. 6 is a schematic representation that exemplifies a gas-lighter system used in combination with a plurality of taps of the type of FIGS. 4 and 5.

FIG. 6 represents in an extremely schematic form a traditional connection between the microswitches MS, mounted on the taps 10, and the gas-lighter system, in a cooking appliance, of which five gas burners are represented, designated by 5*a*. The lighter module, designated by IS, of a conception well known in the sector, supplies pairs of electrodes—here designated by the reference E+ and by the ground symbol—corresponding to the respective burners 5*a*, for generating between them sparks designed to bring about lighting of the gas.

The microswitches MS may be connected individually to the module IS, or else be provided already wired in parallel to one another to constitute a so-called "catenary". The lighter module IS is supplied with the 220-Vac mains supply voltage, and connected along a wiring thereof are the microswitches MS. It will consequently be appreciated that, according to the known art, to the microswitches MS mounted on the various taps 10, there is delivered the 220-Vac mains-supply voltage, which is a source of potential risks for a user, for example in the case of electrical dispersion.

Figure 7:
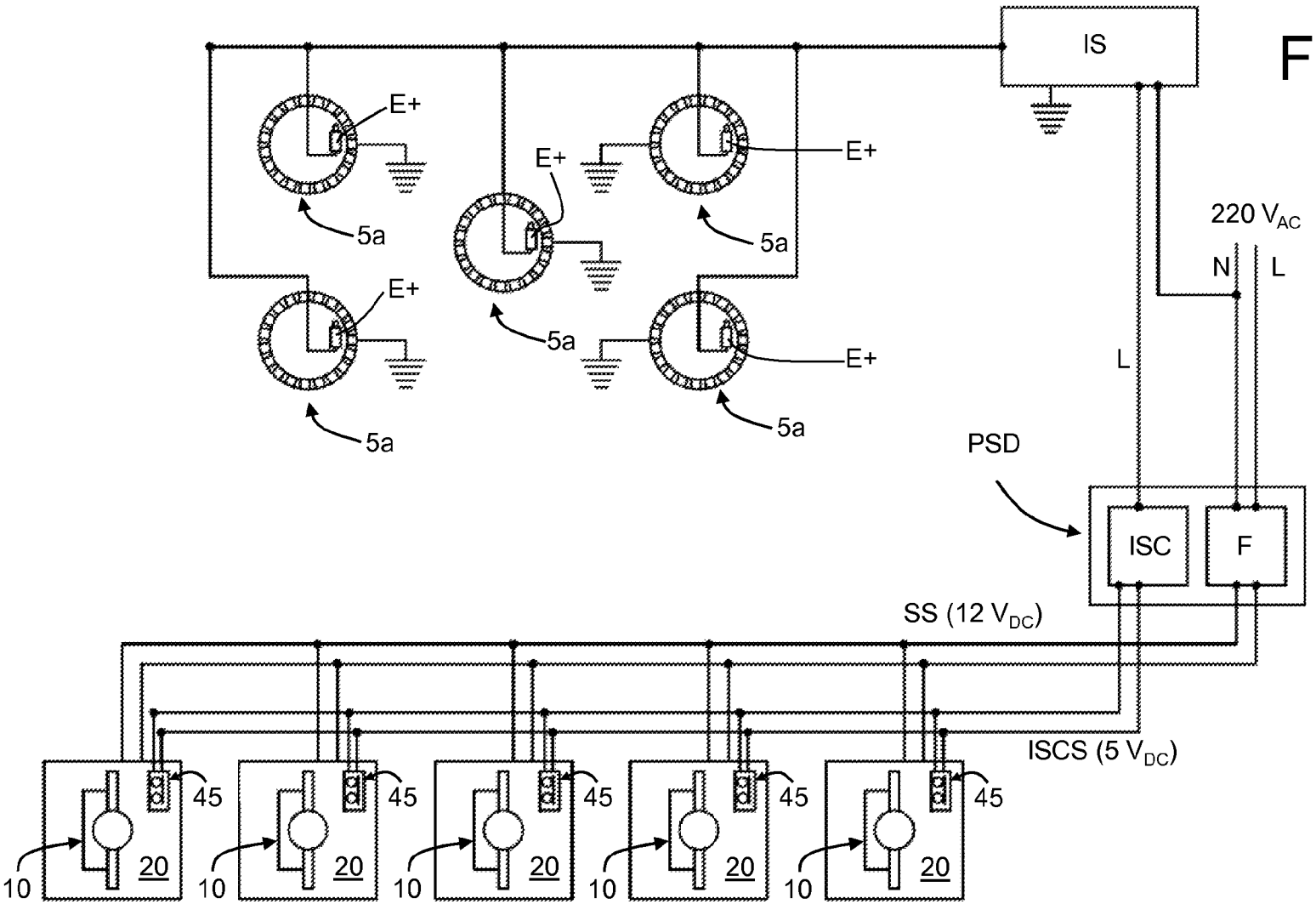
FIG. 7 is a schematic representation of a control device according to a possible embodiment of the invention.
Figure 8:
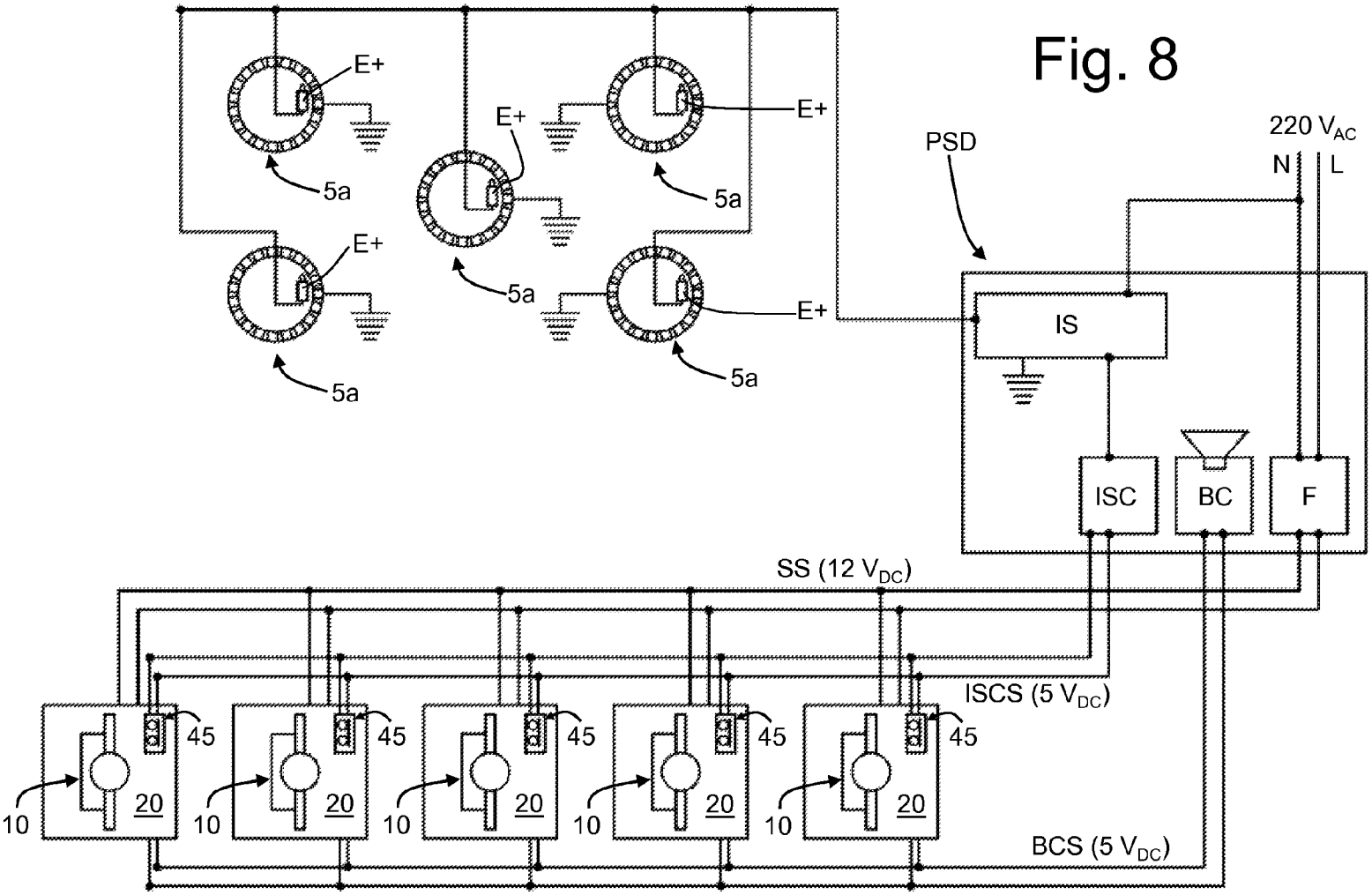
FIG. 8 is a schematic representation of a control device according to a further possible embodiment of the invention.

FIGS. 7 and 8 illustrate possible principle diagrams of a timer system according to the invention. It should be noted that the modalities of connection between the various elements represented must be understood as provided merely by way of example, in so far as it is aimed at illustrating the general architecture of the system, distinguished by the presence of one or more timer devices 20 coming under just one device that concentrates a number of common resources of the system itself, such as a low-voltage supply stage or circuit, a lighting-control stage or circuit, an acoustic-warning and/or visual-warning stage or circuit. In this architecture, the devices 20 provide control modules associated to the various taps 10, whereas the device PSD provides a central or common module.

FIG. 7 illustrates a first possible principle diagram of a timer system according to the invention. In this embodiment, the system includes a unit or module for supply and management of common resources, hereinafter referred to for simplicity as "supply device", designated as a whole by PSD. The device PSD is connected between the 220-Vac electrical mains supply and the lighter module IS and one or more timer devices 20, which form control modules, each of which is associated to a respective tap 10. The device PSD is mounted on the household appliance, preferably within its structure, in a remote position with respect to the devices 10, to which it is connected via corresponding wiring.

In a particularly advantageous embodiment, the supply device PSD includes a stage or circuit F for low-voltage supply of the devices 20, for example with a nominal voltage of 10 Vdc and a maximum voltage of 12 Vdc, designated in FIG. 7 by SS (appearing in the figures is the maximum value of 12 Vdc). In a preferred embodiment, the device PSD further includes a power stage or circuit ISC, for control of the lighter module IS, operatively connected between the electrical mains supply and the module IS itself.

In the timer system according to the embodiment referred to above, the stage ISC provides a sort of control interface between the low-voltage timer devices 20 and the lighter module IS at the mains voltage Vac. In one embodiment, the stage ISC is configured for detecting a signal, or closing a low-voltage contact 45 of the devices 20, and governing an electronic power switch of its own (such as a triac, an opto-triac, a MOSFET or a relay), which controls the lighter module IS accordingly. In this way, the solution is intrinsically safe, in so far as there is avoided the need to carry the 220-Vac mains voltage directly onto the tap 10, as instead occurs according to the known art (the tap 10 and/or the corresponding shaft 11, which are typically made of metal material, may be subject to contacts with the user, for example following upon removal of the knob 12 during the customary cleaning operations, with consequent risks of electrocution).

In the example represented in FIG. 7, the low-voltage signal that reaches the contact is designated by ISCS and is a 5-Vdc signal. The contact 45 may be of a mechanical or electromechanical or electronic type, driven directly by the control rod 11 of the tap 10 (for example, a contact or a Hall sensor implemented directly by the rod 11, even independently of the timer circuit of the device 20). The contact 45 could in any case be actuated in some other way, even indirectly, for example with the knob of the tap that presses on an ring nut of the device 20 and said ring nut operates the contact.

FIG. 8 illustrates a further possible principle diagram of a device or timer system, according to a particularly advantageous embodiment of the invention. In this embodiment, the supply device PSD includes, in addition to the stages F and ISC referred to previously, also a signalling or warning stage, in particular for acoustic warning, designated by BC, aimed at indicating various conditions of operation of the timer devices coming under it. The warning stage BC may include for example an acoustic-warning device, such as a buzzer or beeper, which may, in particular, be controlled by a low-voltage analog or digital signal, which may be generated by each of the devices 20 served by the supply device PSD. In the example represented in FIG. 8, the low-voltage control signal of the stage BC is designated by BCS and is a 5-Vdc signal (in particular, a square wave of 2 kHz generated sporadically, i.e., in the event of warning, when the 5-Vdc signal is modulated at 5 Vp-p with pauses at Vdc for driving the buzzer.

In a possible embodiment (not represented), the stage ISC, which is in any case designed to govern the lighter module IS, is configured for detecting the state or level of a low-voltage signal (for example, at 5 Vdc, whether analog or digital; such as a variation of d.c. voltage or else a serial signal) generated by a device 20, for governing the aforesaid electronic power switch.

In a possible embodiment (not represented), the warning stage BC may comprise a viewing means, such as a display, in addition or as an alternative to an acoustic-warning device. Also in this embodiment, the display part receives a signal (whether analog or digital) from a device 20 for generating the visual warning.

In one embodiment, such as the one represented in FIG. 8, the device PSD may integrate also the lighter module IS, but this is to be understood as an option, aimed at concentrating in a single electrical device—i.e., the device PSD—a number of stages or circuits subject to the a.c. mains voltage, it being possible to house the device in the area of the gas appliance deemed most convenient, in a remote position with respect to the devices 20. It will be appreciated that, even with a basic configuration of the type illustrated in FIG. 8, the module IS could be distinct from and external to the device PSD. It should also be emphasized that the timer system forming the subject of the invention may be used in principle also in gas appliances without a lighter system so that the presence of the module IS and of the stage ISC is to be understood as optional. In general terms, consequently, in the preferred embodiment of the invention, the supply device PSD includes the supply stage F and at least one between the control stage ISC and the warning stage BC.

Figure 9:
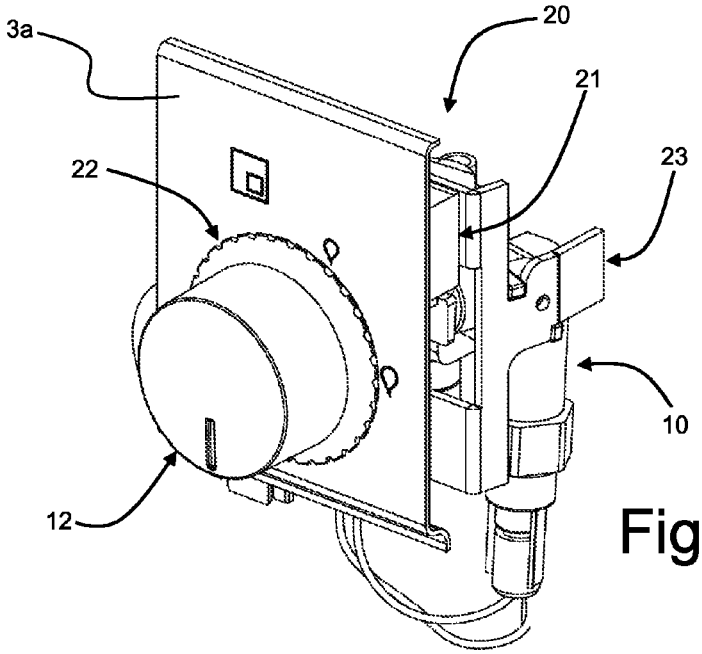
FIG. 9 is a partial and schematic perspective view of a control device according to the invention, in a condition where it is installed on the appliance.
Figure 10:
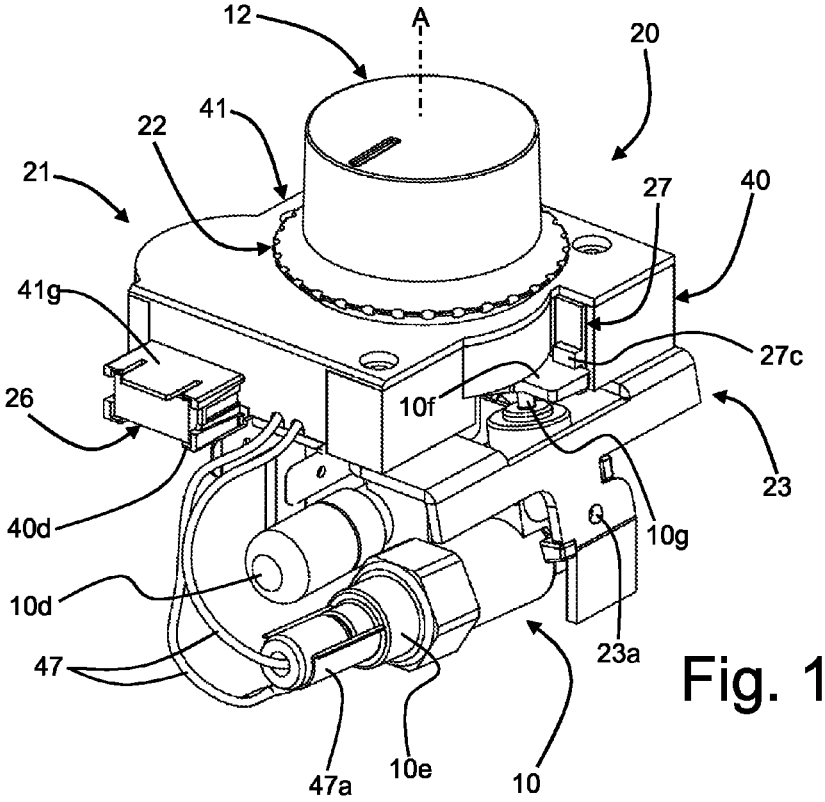
FIG. 10 is a partial and schematic perspective view of the device of FIG. 9, but from a different angle and with a part of the appliance removed.

Visible in FIGS. 9 and 10 is a timer device 20 according to a possible embodiment of the invention. The supporting structure of the device 20 comprises a boxlike casing 21—for housing at least part of a corresponding circuit arrangement—as well as a command means 22 for setting at least one time of supply of gas to the burner controlled by the corresponding tap 10. In the condition where the device 20 is assembled on the appliance (FIG. 9), the casing 21 is housed within the structure 2-3, and hence in a concealed position, with just the command means 22 accessible from outside. Preferably, the casing 21 is set between a rear portion of the tap 10 and the wall 3*a* of the structure provided with the opening projecting from which is at least the actuation rod 11. Very preferably, the casing 21 is shaped so as to receive through it at least part of a front portion of the tap 10. For this purpose, in a preferred embodiment, the casing 21 is shaped so as to define a passage, inserted within which is the aforesaid front portion of the tap. As will be seen hereinafter, in one embodiment, various components of the device 20 (such as the ones designated hereinafter by 25, 40 and 41) are purposely configured for determining the presence of the aforesaid passage.

In a preferred embodiment, the command means 22 comprises a ring nut member or knob, which is operatively set between a knob 12 for manual actuation of the rod 11 of the tap 10 and the outer face of the wall 3*a*. In the assembled condition of the device 20, the control means 22—hereinafter referred to for simplicity as "ring nut"—is mounted movable, in particular rotatable, and is basically coaxial to the knob 12. In one embodiment (not represented), the ring nut 22 may also be axially movable, for example in order to bring about switching of control elements of the tap 10 and/or of the device 20. Of course, the shape and proportions of the ring nut 22 as represented, with respect to the knob 12, are merely indicative.

In a preferred embodiment, the ring nut 22—which can function as light guide for performing also light-warning functions—represents the only component of the device 20 that is visible and operable from outside the structure of the appliance 1. In other possible embodiments, from the outside of the aforesaid structure there may be noted at least partially also other components of the device 20, for example a light-warning element.

In a preferred embodiment, the structure of the device 20 has means for coupling the casing 21 to the body of the tap 10. In the example illustrated, the coupling means comprise a bracket 23, which is preferably made of metal or thermoplastic material and is operatively set between the casing 21 and the body of the tap 10. Advantageously, the bracket 23 has at least one hole 23*a* for its fixing, which can be carried out by exploiting at least one screw that is normally associated to the body of the tap 10, for example a screw used for its fixing to the structure of the appliance 1 or a screw S that, according to the known art, is used for fixing the microswitch MS referred to previously (FIGS. 3 and 4). Also fixing of the casing 21 to the bracket 23 can be obtained with screws, or else via mutual coupling and engagement means, such as engagement reliefs or teeth that. fit in respective seats. In variant embodiments (not represented), the bracket 23 may be associated to or integrated with the casing 21, for example by overmoulding plastic material of a part of the casing 21 on the bracket 23, or shaping a part of the body of the casing 21 like a bracket, in order to perform directly functions of coupling to the body of the tap. In other possible embodiments (not represented), the casing 21 of the device may be fixed to the structure of the appliance 1, via a purposely provided bracket or else directly.

FIGS. 11 to 14 show, from different angles, the components of the device 20 according to one embodiment of the invention, as well as some components of the appliance 1 already referred to previously. Visible in these figures are the tap 10, the mounting bracket 23, a first part 40 of the casing 21, a circuit arrangement 25 that equips the device, a connector 26 belonging to an external wiring system (not represented) for connection to the supply device PSD of FIG. 7 or FIG. 8, a control or motion-transmission element 27 for a switching means of the circuit arrangement 25, a transmission member 28 co-operating with the movable part of a sensor of the arrangement 25, a further transmission member 29 which can be actuated by the ring nut 22 to turn the member 28 accordingly, a member 30 intermediate between the transmission member 29 and the ring nut 22, a second part or lid 41 of the casing 21, a sealing element 31, which is preferably of an annular type, designed to operate between the ring nut 22 and the front surface of the wall 3, and an intermediate annular element 32, which is designed to be operatively set between the knob 12 of the tap 10 and the ring nut 22 and is forced on the latter by a spring—not represented—set between the inside of the knob 12 and the intermediate annular element 32.

As already mentioned, the tap 10 may be of a type in itself known on the market, as described in the introductory part of the present description and with reference to FIGS. 4 and 5. In traditional applications, as has been said, the actuation element 10*f* may advantageously be exploited also for causing switching in closing of the microswitch MS forming part of the lighter system. As will be seen, in a particularly advantageous embodiment of the invention, the circuit arrangement of the device 20 includes a switching means, which performs also the functions of the aforesaid microswitch MS provided according to the known art. In the case of use of the timer device according to this embodiment, as exemplified here, the traditional microswitch MS may be omitted, and the screw S normally used for its fixing (FIGS. 3 and 4) may be exploited for fixing the bracket 23 to the body of the tap 10.

Figure 11:
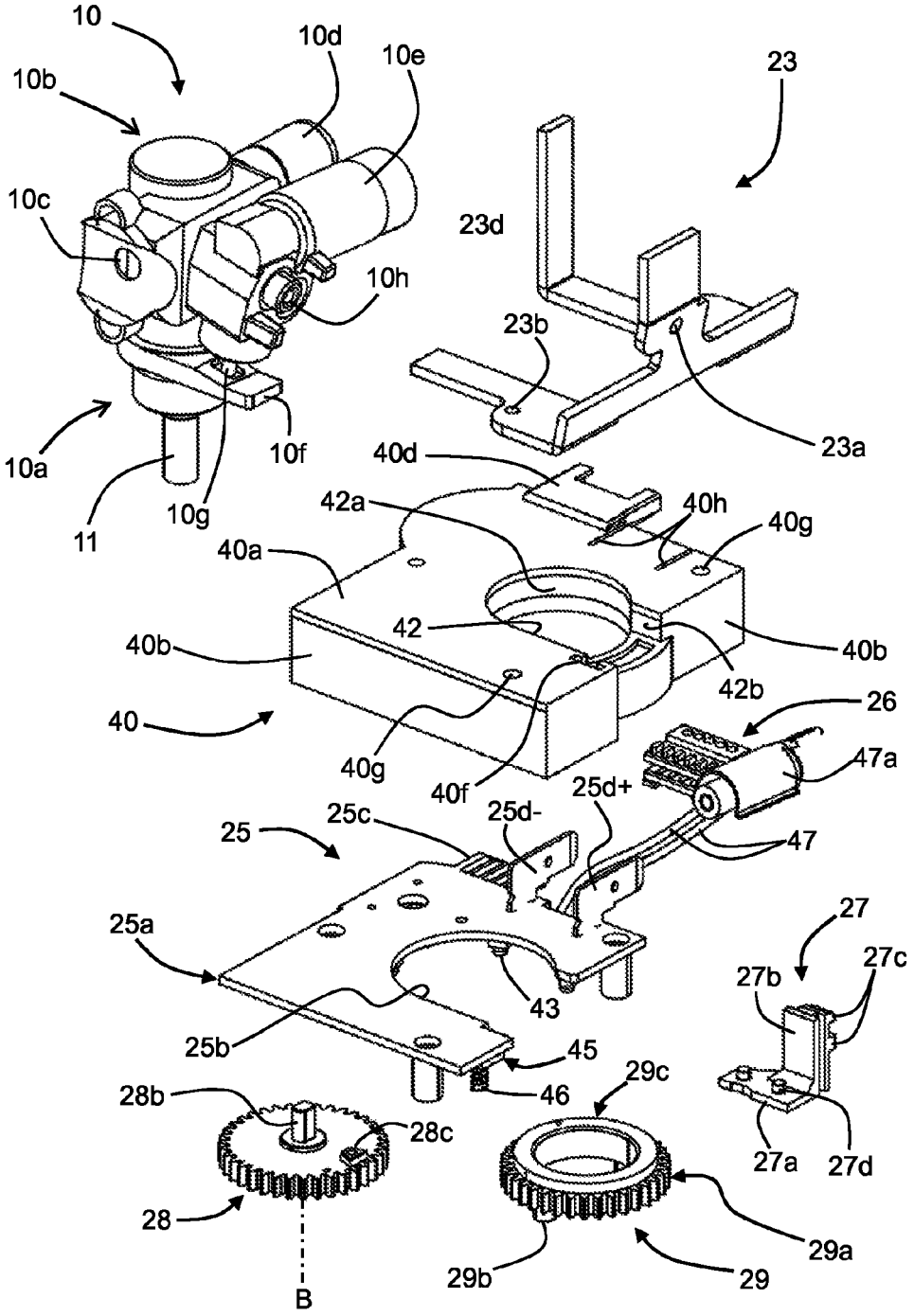
FIGS. 11-14 are exploded views, from different angles, of the device of FIGS. 9 and 10.
Figure 12:
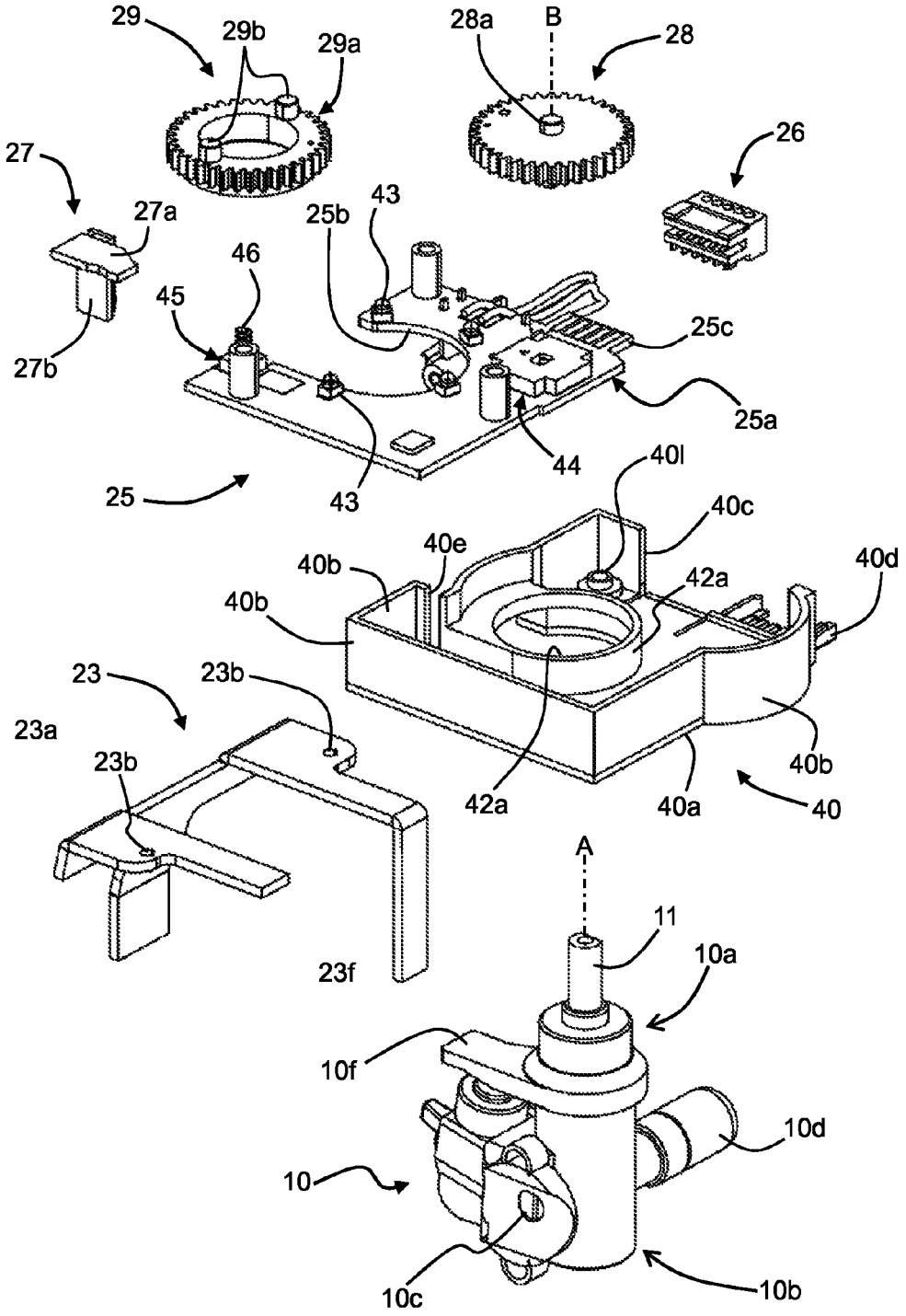

A possible embodiment of the bracket 23 may be seen in FIGS. 11 and 12, in the structure there being provided the hole 23*a* for passage of a screw (not represented), for example for engagement in an internal screw 10*h* provided on the body of the tap 10. The internal screw may advantageously be the one usually envisaged for the screw S for fixing the microswitch MS provided according to the known art. The structure of the bracket 23 then envisages holes 23*b* for securing the casing 21, for example via screws. It should be noted that the shape illustrated for the bracket 23 is to be understood merely as an example, other shapes being evidently possible, according to the shape of the tap and/or to the structure of the appliance.

The part 40 of the casing defined hereinafter for simplicity as "container" is substantially box-shaped and made of plastic material, with a bottom wall and peripheral walls that define a cavity or a seat for housing at least part of the circuit arrangement 25 and of the transmission arrangement including the transmission members 28-30. Preferably, one of the peripheral walls 40*b* closes only partially the corresponding side of the container 40, thus defining a side opening 40*c* (FIG. 12). At said side opening 40*c*, from the bottom wall 40*a* an appendage 40*d* projects outwards, aimed at providing a first part of a connector body, visible as a whole in FIG. 5, fitted within which is the connector 26.

In a preferred embodiment, one of the peripheral walls 40*b* has an opening or gap 40*e* (FIG. 12), the function of which will be clarified hereinafter, to which there preferably corresponds a slit 40*f* (FIG. 1) defined in the bottom wall 40*a*. In one embodiment, such as the one represented, the bottom wall 40*a* is also provided with holes 40*g* for fixing the casing to the bracket 23, as well as a pair of slits 40*h* (FIG. 11), which are preferably generally parallel and in a position set alongside with respect to the appendage 40*d*.

The casing 21 of the device 20 is configured for coupling with the body of the tap 10, and for this purpose has a passage, in which a corresponding part of the tap may be received passing through it. For example, in the embodiment illustrated, the bottom wall 40*a* has a through opening 42, which is preferably, but not necessarily, substantially circular. Preferably, moreover, the container 40 defines a hollow portion, projecting within the corresponding cavity, where the opening 42 is located. Very preferably, moreover, the container 40 also defines an external recess, for housing partially, and with possibility of movement, the actuation element 10*f* of the tap 10.

In the embodiment illustrated, the bottom wall 40*a* and the peripheral wall 40*b* that has the gap 40*e* define together, within the container 40, the aforesaid hollow portion 42*a*, having an outer profile that is at least in part cylindrical. As may be seen in FIG. 11, moreover, a part of the bottom wall 40*a* defines the aforesaid external recess 42*b*, between the opening 42 and a respective wall 40*b*, in particular the one provided with the gap 40*e*.

Figure 15:
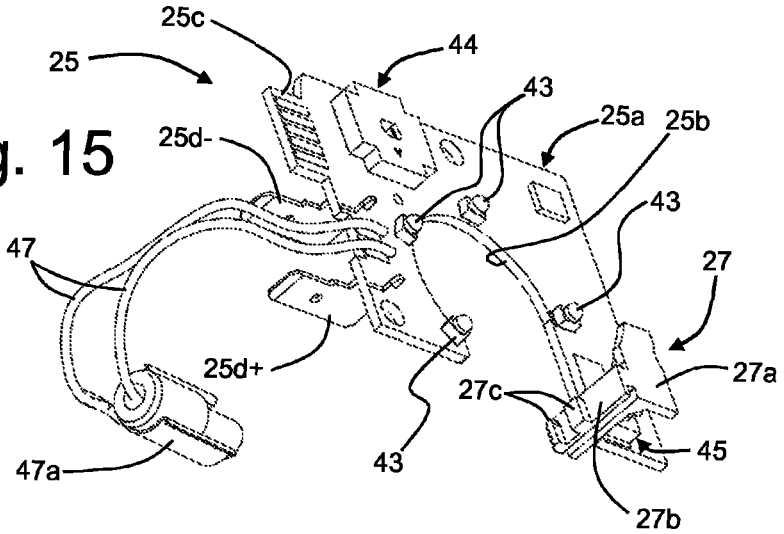
FIGS. 15 and 16 are perspective views, from different angles, of a circuit arrangement of the device of FIGS. 9 and 10.
Figure 16:
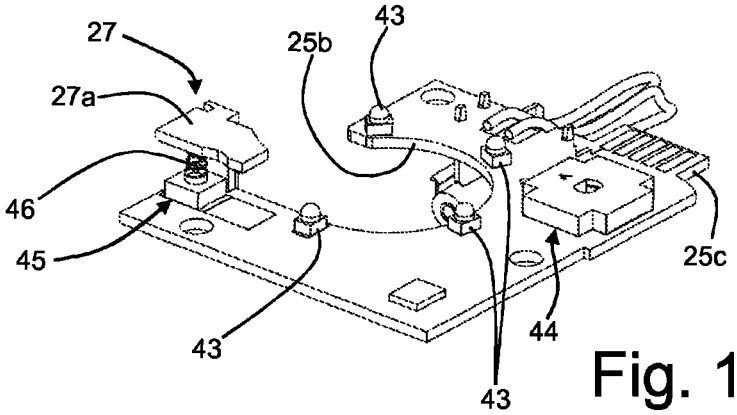

With reference also to FIGS. 15 and 16, the circuit arrangement 25 preferably includes a printed-circuit board (PCB), designated by 25*a*, which is at least partially housed within the casing 21 and mounted on which are electrical and/or electronic components, connected to tracks (not represented) made of electrically conductive material defined on the circuit board 25*a*. Illustrated in the figures are only the components useful for an understanding of the invention, other electronic components being, however, possibly present, such as active or passive components or microcontroller circuits or memories.

In one embodiment, the circuit board 25*a* has a respective passage that surrounds at least in part the passage of the casing 21. In the example of embodiment, the passage of the circuit board 25*a* is in the form of an opening or slot 25*b* having a profile at least in part similar to or congruent with that of the opening 42 of the bottom wall 40*a* of the container 40 and/or of the corresponding hollow portion 42*a*, and the circuit board 25*a* is mounted in a position generally close to the bottom wall 40*a*. In the example, the slot 25*b* extends as far as an edge of the circuit board 25*a* and has at least a corresponding portion shaped like an arc of circumference. In other embodiments, the passage of the circuit board 25*a* may be circular, such as a hole, for example if the portion 42*a* is generally cylindrical or if it is absent.

The specific embodiment of the control circuit provided on the circuit board 25*a* may comprise—in general terms—the components described in WO 2010/134040, for performing the functions described in said document and/or other specific functions envisaged according to the present invention. An example of circuit will in any case be described hereinafter with reference to FIG. 21. For what is of specific interest herein—and also with reference to FIGS. 15 and 16—in one embodiment, a projecting portion 25*c* of the circuit board 25*a* provides a male connector, the terminals of which are obtained from electrical tracks, in particular of an edge-connector or card-edge type, which, in the condition where the device 20 is assembled, is in a position corresponding to the appendage 40*d* of the container 40, provided for coupling with the external connector 26.

In one embodiment, the circuit arrangement 25 includes light-emitting means, which may comprise one or more emitters, for example of a LED type. Preferably, these emitter means are mounted on a face of the circuit board 25*a*—here defined as upper face—in the proximity of the passage of the casing 21. In the example represented, a number of emitters 43 are provided, arranged at intervals apart around the slot 25*b*. Given that, in the example, the slot 25*b* extends as far as an edge of the circuit board 25*a*, the emitters 43 are arranged according to the profile of the arc-shaped part of the slot itself, preferably at substantially regular intervals.

The circuit arrangement 25 comprises sensor means, for detecting the angular position of the ring nut 22 and supplying accordingly a signal representing a time interval of supply of the burner controlled by the tap 10. In the example, these sensor means include a stationary component 44, preferably mounted on the upper face of the circuit board 25*a*. In one embodiment, the sensor means are of a resistive type, such as a rotary potentiometer or trimmer, actuated by a corresponding part that may be set in rotation following upon a rotation of the ring nut.

In one embodiment, the signal for activation of the timing function of the device 20 is supplied to the circuit arrangement 25 by a control element. Preferably, this control element comprises a switching means, such as a pushbutton switch, preferably a low-power switch, in particular, for voltages ranging between 1 V and 24 V, which can be switched following upon axial displacement of the rod 11 of the tap, for example, the switch designated by 45 in FIGS. 7 and 8. Advantageously, if the circuit of the device 20 is prearranged also for connection to a system for lighting the burners of the appliance 1, the signal generated by switching of the control element may also be used for governing the lighter system, as in the case illustrated in FIGS. 7 and 8. In the example represented in FIGS. 15 and 16, the control element represented by the pushbutton switch 45 is provided on the upper face of the circuit board 25*a*. Preferably, but not necessarily, the switch 45 is a double-contact switch.

In one embodiment (not represented), the device 20 with the control element 45 can be provided just for control of the lighter system (and hence without timing functions), with said device 20 preferably associated to the supply device PSD or possibly just to the power stage ISC.

The motion-transmission element 27 is configured for transmitting an axial movement of the control rod 11 of the tap 10 to the switch 45, and for this purpose is mounted movable on the casing 21, in particular in a slidable way. At least one part of the motion-transmission element 27 faces the outside of the casing 21 in order to be able to interact or couple with the actuation element 10*f* of the tap 10. In embodiments not represented, it is also possible to provide a motion-transmission element configured for direct coupling to the rod 11.

In the embodiment exemplified, the element 27 has a base part 27*a* and an upright part 27*b*, the latter being shaped for engaging slidably in a vertical direction in the gap 40*e* (FIG. 12) and in the slit 40*f* (FIG. 11). In effect, and as may be appreciated, for example, in FIG. 10, the element 27 is coupled to the container 40 so that its base part 27*a* overlies the pushbutton of the switch 45 in order to be able to cause switching thereof, in particular, via further interposed elastic means (see, for reference, FIG. 16). The upright part 27*b* of the element 27 facing the outside of the casing 21 has a seat for engagement of the element 10*f* of the tap, said seat being here defined by two projections 27*c* (FIGS. 11 and 15) received between which is a part of the element 10*f*. In this way, the axial movement of the rod of the tap, due to pressure applied on the knob 12, brings about a corresponding vertical movement of the element 27 (downwards, as viewed in FIG. 10).

In a preferred embodiment, between the control element represented by the switch 45 and the corresponding actuation element 27, the aforesaid elastic means, or damping means, are provided, in particular having the function of operating the pushbutton of the switch 45 and compensating for possible tolerances of production and assembly and/or preventing risks of excessive stresses exerted by the element 27 on the switch 45. In the embodiment exemplified, and as may be appreciated, for example, in FIG. 16, said means comprise an elastic element 46, in particular a helical spring, operatively set between the element 27 and the pushbutton of the switch 45. In the example, one end of the spring 46 is fitted on a pin 27*d* (FIG. 11) projecting from the lower face of the head part 27*a* of the element 27, and the opposite end is engaged on the pushbutton of the switch 45. The spring 46 is calibrated so that, beyond a certain degree of compression thereof, it will transfer to the pushbutton of the switch 45 the force necessary for switching, said spring 46 being also able to absorb or compensate for possible excessive stresses. In embodiments not represented, the damping function can be integrated directly in the motion-transmission element, for example by providing in its body an elastically deformable part, having spring functions.

The circuit arrangement 25 of the device includes first connection means for electrical connection to the electromagnet of the safety valve of the tap 10. Once again with reference to the example of FIGS. 11-12 and 15-16, connected to the circuit board 25*a* are electrical conductors 47, represented schematically, for connection of the circuit of the device 20 to the electrical attachment or connector 10*e* of the tap 10, i.e., the attachment where the thermocouple is traditionally connected. Connected to the conductors 47 of the arrangement 25 is a corresponding connector 47*a*, of a type complementary to the attachment 10*e* of the tap 10 and/or to the electrical connector of the electromagnet of the safety valve. Preferably, the connector 47*a* is of a type designed to perform the functions of connection proper to the traditional connectors for thermocouples used on taps of the type considered herein, in particular, a connector 47*a* of an axial type, or of a radial type, or of a Faston type.

In the example represented, the connector 47*a* includes two generally coaxial parts, not indicated, and in particular a central part and a peripheral part. The central part, which is at least partially cylindrical, is made of electrically insulating material and defines at the centre an axial seat (FIG. 13), housed within which is a corresponding contact, connected to one of the conductors 47. The peripheral part, connected to the other conductor 47, is in the form of a shaped metal lamina, fitted on the central part and with a corresponding generally arched contact portion that surrounds at least partially the insulating central part, at a distance therefrom. The central part of the connector 47*a* can be inserted in the attachment 10*e* for the thermocouple (see FIG. 10) so that in the corresponding axial seat there fits a terminal with central pin of the attachment 10*e* (see, for example, FIG. 5), which thus electrically couples to the internal contact of the seat itself. The arched portion of the peripheral part of the connector 47*a*, by exploiting a certain elasticity thereof, bears, instead, upon an external cylindrical part of the attachment 10*e*.

In variants not represented, the conductors 47 may be absent, with the connector 47*a* connected or associated directly to the support of the circuit arrangement 25, with said connector, support, and casing of the device 20 appropriately shaped for enabling a connection to the connector 10*e* of the tap 10.

More in general, the electrical connectors, such as a first connector towards the electromagnet of the safety valve of the tap and a second connector towards the thermocouple, may be of the same type or else of different types: in the latter case, the timer device can function also as "adapter" between different connectors, i.e., between a thermocouple having a first type of connector and an electromagnet or safety valve of a gas tap having a second type of electrical connector, or else a timer 20 having a first connector 25*d* different from a second type of connector 47*a*.

The arrangement 25 likewise includes second connection means for electrical connection to the thermo-electric generator of the tap 10, i.e., the corresponding thermocouple. In the device 20 represented the conductors of the thermocouple—not represented—that equips the tap 10 are connected to the circuit arrangement 25*a* via fast-coupling connectors, which are preferably blade connectors, such as Faston connectors. In the example represented, projecting from the lower face of the circuit board 25*a* are two blade contacts 25*d*+ and 25*d*− (hereinafter, where not strictly necessary, designated simply by 25*d*), in particular of a male Faston type, which are generally L-shaped and are parallel to one another. The contacts 25*d* pass through the slits 40*h* of the bottom 40*a* of the container 40 so that their contact part projects outwards, as may be seen, for example, in FIG. 18, providing an electrical connector of the device 20 for the thermocouple. On the aforesaid projecting part of the contacts 25*d* there may be fitted the connectors of the thermocouple, which in this case are of a female Faston type.

It will be appreciated that, in the example represented, the connection means proper to the thermocouple (here female Faston connectors) are of a different type from the connection means of the thermocouple provided by the tap (here the attachment 10*e* of a coaxial type): the device 20 consequently functions as "adapter", as explained above.

Note that the contacts 25*d* could be replaced by a cable with two conductors provided with a connector for a thermocouple.

In a preferred embodiment of the timer device 20, the movable part of the position-sensor means—actuated by, or including, the shaft designated by 28*b*—is able to rotate about an axis that is different from the axis about which the ring nut 22 turns, in particular is substantially parallel thereto, and operatively set between the ring nut 22 and the movable part of the sensor means is a transmission arrangement; i.e., the device 20 comprises a transmission arrangement, set between the control element or ring nut 22 and the position-sensor means.

In the preferred embodiment, the aforesaid transmission arrangement includes a first transmission member that is substantially coaxial to the ring nut 22 and is able to turn therewith. This first transmission member has an axial cavity, in which there may be received a corresponding part of the tap 10, and the ring nut 22 is coupled in a separable way to this transmission member.

Preferably, the transmission arrangement includes at least one second transmission member, which is engaged in rotation with the first rotating member and is able to set in rotation the movable part of the position-sensor means.

In the example represented, the transmission arrangement comprises the rotating members previously designated by 29 and with 28, which represent the aforesaid first and second transmission members, respectively.

Once again in FIGS. 11 and 12 there may be noted a possible embodiment of the rotating member 28, directly integrated in which is the movable part of the sensor means. For this purpose, the member 28 co-operates with the stationary component 44 of the position-sensor means, such as a variable resistor, hereinafter defined for simplicity as "potentiometer".

Figure 13:
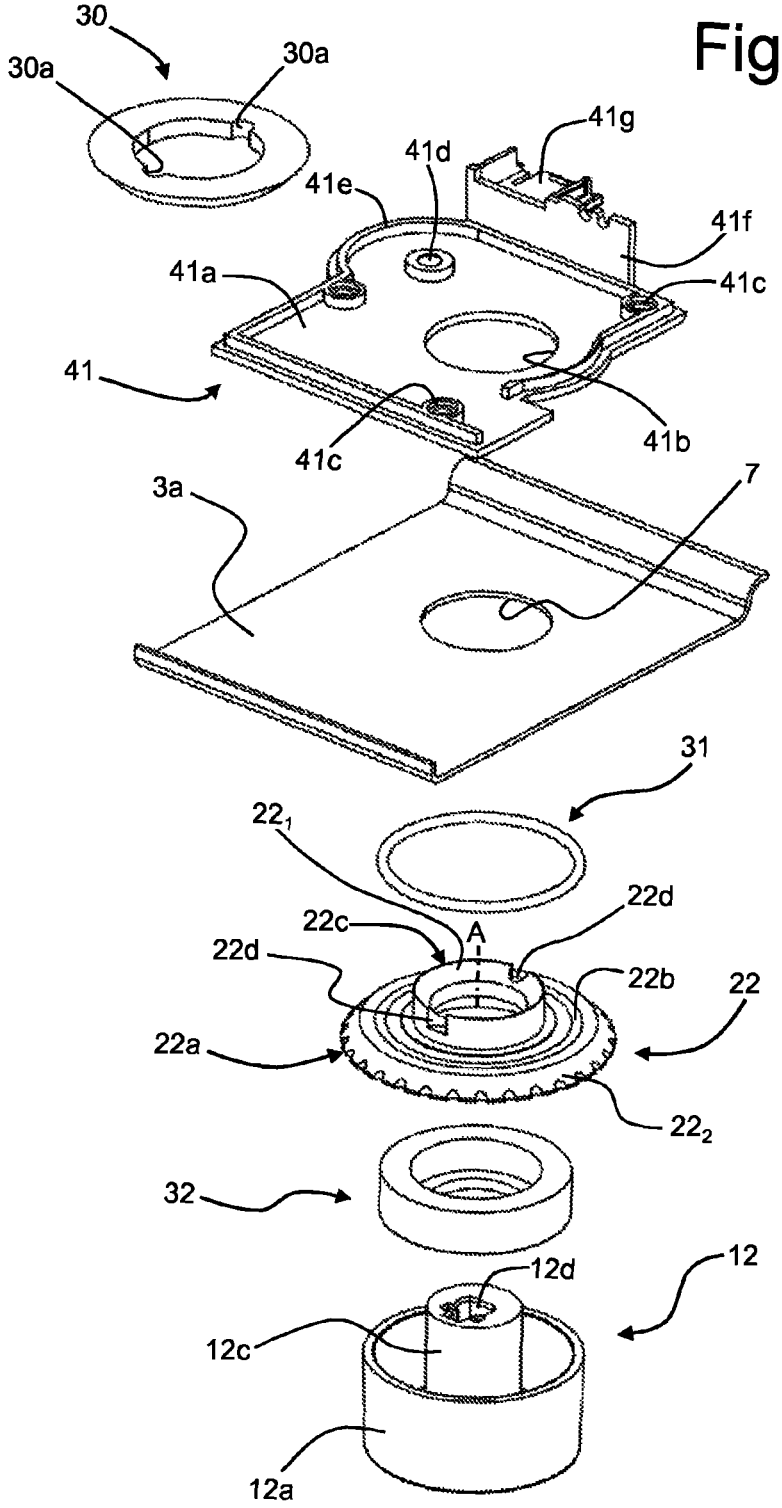
Figure 14:
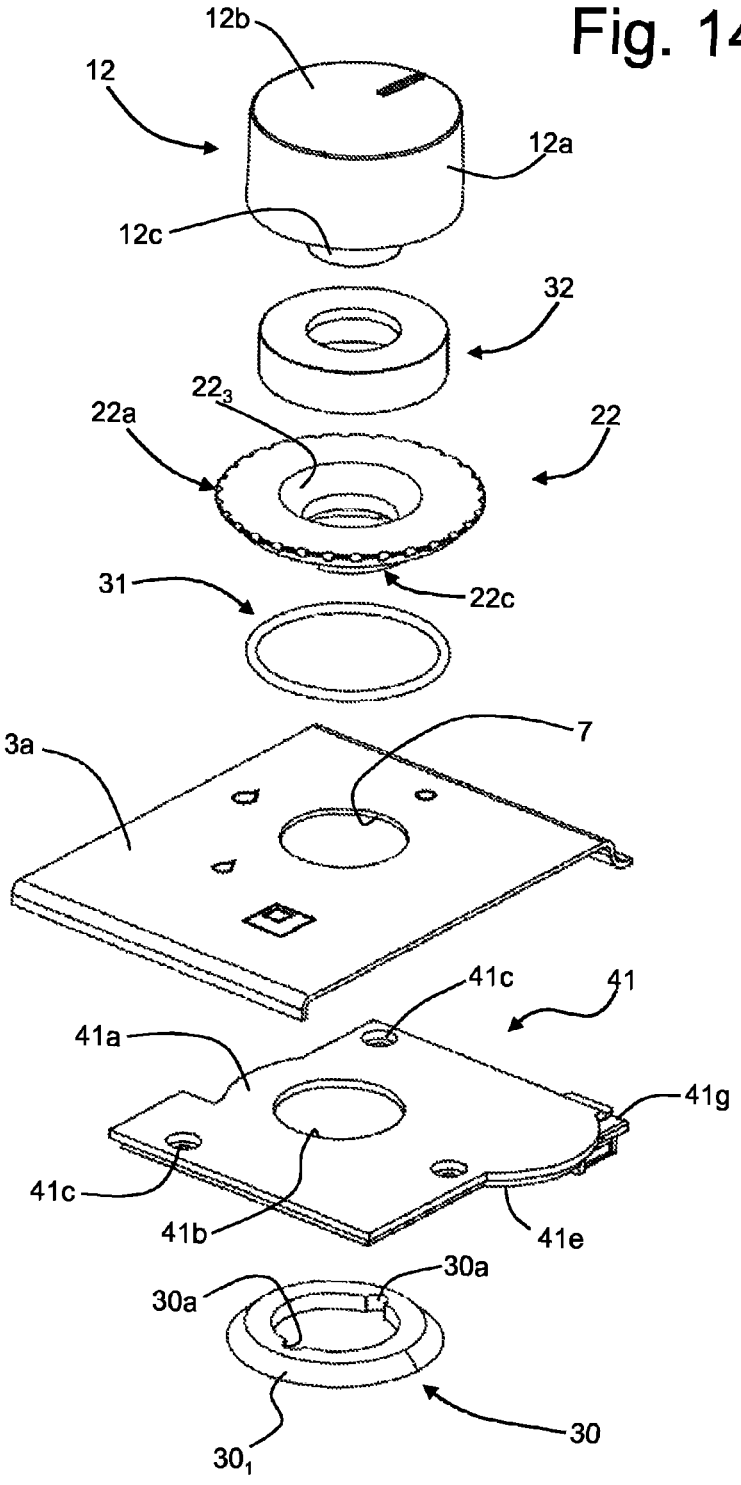

In a preferred embodiment, the member 28 basically comprises a gear, the axis of rotation B of which is defined by a pin 28*a* projecting from its upper face, said pin being designed for engagement in a respective cylindrical rotation seat 41*d* of the lid 41 (FIG. 13).

Projecting, instead, from the lower face of the member 28 is a shaft 28*b*, coaxial to the upper pin 28*a*, which provides the movable part of the position-sensor means. The shaft 28*b* preferably has a cross section that is at least in part square (not circular), designed to couple mechanically to an internal movable member of the potentiometer 44: in practice, then, the shaft 28*b* of the member 28 provides the element for actuation of the potentiometer 44.

In a preferred embodiment, mechanical end-of-travel means are provided for rotation of the member 28, which preferably comprise an element carried by the member itself, designed to interact with a stationary contrast element. For this purpose, in the case represented, projecting from the lower face of the member 28 is an arrest element 28*c*, designed to interfere with a fixed contrast element (not visible) of the container 40. The angular area corresponding to a complete rotation—for example in a clockwise direction—in the proximity of the contrast element 40*i* defines an area or position of mechanical zero. This angular area, which may be approximately 12° wide, has a particular meaning for operation of the device 20, in so far as, together with the ring nut 22 positioned in the aforesaid area, it is generally in a state of inactivity. In this example, then, the duration of the interval of supply of the burner increases with rotation of the ring nut 22 in a counterclockwise direction. According to variants not represented, means for providing a snap coupling or engagement that defines an angular position or angular area of mechanical zero may be associated to other elements of the device, such as the ring nut 22 and/or the member 29.

The second rotating member 29 constitutes an axially hollow transmission element, which can be coupled in a separable way to the ring nut 22 and is coaxial thereto in order to turn according to the axis denoted by A in various figures, also corresponding to the axis of rotation of the stem 11 of the tap 10. For this purpose, in the example illustrated, the member 29 comprises a circular ring gear 29*a*, projecting from the upper face of which are engagement elements 29*b*. Preferably, at least two engagement elements 29*b* are provided in diametrally opposite positions. Very preferably, the engagement elements 29*b* have a substantially cylindrical shape.

Advantageously, the transmission member 29 is rotatably supported by a corresponding portion of the casing 21, at the corresponding passage. For this purpose, in the example represented, projecting from the lower face of the circular ring gear 29*a* is a cylindrical annular part 29*c*, having a smaller circumference than the one defined by the teeth of the ring gear 29*a*. The cylindrical part 29*c* is designed to insert with minimal play or with slight interference in the through opening 42 of the bottom wall 40*a* of the container 40 so that it can turn therein about the axis A. In the assembled condition of the device 20, and as may be noted, for example, in FIG. 17, the toothings of the two members 28 and 29 mesh together so that rotation of the member 29 causes rotation of the member 28, and hence of the shaft 28*b*, coupled to the angular sensor represented by the potentiometer 44.

Coming now to FIGS. 12-13, in a preferred embodiment, the transmission arrangement also includes the intermediate member 30, prevalently located within the casing of the device 20. The intermediate member 30 has a respective axial cavity and is operatively set between the ring nut 22 and the transmission member 29 so as to turn therewith according to the axis A. The ring nut 22, prevalently located on the outside of the appliance 1, is preferably made of transparent material, for example a transparent thermoplastic material, such as polycarbonate or methacrylate, for performing functions of light guide or optical guide, in order to receive and/or transfer light radiation, in particular, from the inside to the outside of the appliance 1.

The through cavity of the member 30 preferably has a diameter greater than that of the member 29. Preferably, the intermediate member 30 has a generally annular shape, with an end face facing the upper face of the toothed member 29, in order to be able to rest at least partially thereon.

According to an advantageous characteristic, an optical guide is provided—here made up of a number of parts, such as the elements 22 and 30—preferably made of transparent thermoplastic material, for transferring a light signal from the inside of the device 20 and/or of the appliance 1 to the outside of the appliance 1.

In one embodiment, the member 30 performs functions of light guide or optical guide, for transfer of light radiation generated by the emitter means 43 to the ring nut 22. In this embodiment, the member 30 and at least part of the ring nut 22 are made of a transparent material, for example methacrylate, or in any case a material that is able to transmit the light generated by the emitters 43.

Figure 17:
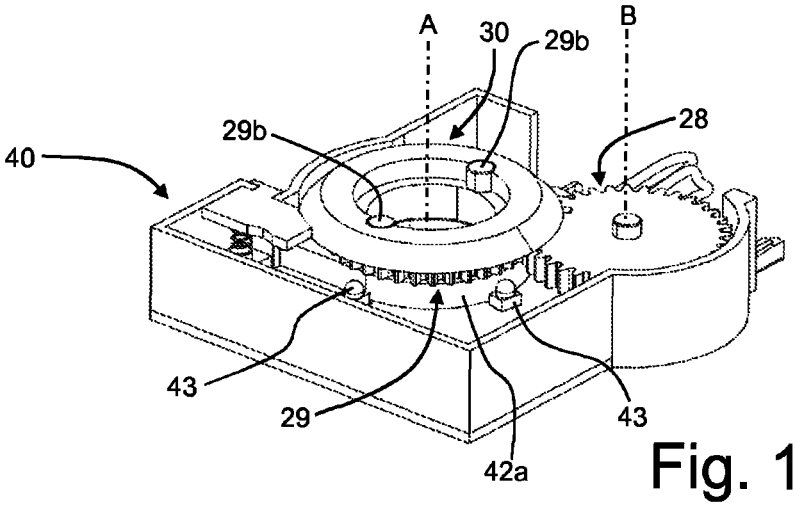
FIG. 17 is a partial perspective view of the device of FIGS. 9-10, partially assembled.

For this purpose, in a preferred embodiment, the diameter at the base of the member 30 is greater than the diameter defined by the teeth of the member 29 so that a peripheral annular region of the upper face of the member 30 faces directly the emitters 43, as may be noted, for example, from FIG. 17. Preferably, the intermediate member 30 has a frustoconical outer profile, in particular with an inclination of its peripheral wall substantially equal to 45° with respect to the base. In this way, the light radiation generated by the emitters 43 impinges on the annular region of the lower face of the member 30 that projects beyond the member 29. The light radiation is reflected within the body of the member 30 by the peripheral wall, in a substantially orthogonal or radial direction, i.e., towards the surface of the axial cavity of the member 30. As will be seen hereinafter, in the axial cavity of the member 30 there is received, preferably in a separable way, a corresponding portion of the ring nut 22, which can then transfer the light frontally, beyond the wall 3*a* of the appliance.

The inner surface of the member 30 defines seats 30*a*, in the form of axial recesses, of a shape complementary to at least part of the outer profile of the engagement elements 29*b* of the member 29 in order to enable mutual coupling thereof that enables transmission of a rotation of the member 29 to the member 30, as may be seen, for example, in FIG. 17. In the example of embodiment illustrated, then, at least two seats 30*a* are provided, in diametrally opposite positions, preferably having a substantially semi-cylindrical profile.

The lid 41 of the casing, made of plastic material, has a respective bottom wall 41*a*, defined in which is a through opening 41*b*, here circular, which forms part of the aforesaid passage of the casing 21 and inserted in which is part of the tap 10. In the example, the through opening 41*b* has a diameter substantially corresponding to that of the opening 42 of the container 40 and/or substantially corresponding to the diameter of the portion of tap 10 on which it is mounted. The bottom wall 41*a* of the lid 41 also has holes 41*c* for the passage of the screws used for fixing the lid and the container together and/or with respect to the bracket 23, the screws also passing between the spacer bushings 25*f* previously mentioned. On the internal face of the lid 41 the cylindrical seat 41*d* is also defined, for receiving a corresponding portion of the pin 28*a* of the toothed member 28.

Projecting from the same face of the lid 41, preferably along the corresponding perimeter, are reliefs 41*e*, for centring the lid itself on the container 40, as well as a side wall 41*f*, designed to close the opening 40*c* of the container 40 (FIG. 12). Projecting outwards from the aforesaid wall 41*f* is an appendage 41*g*, set in a position corresponding to that of the appendage 40*d* of the container 40. In the assembled condition of the device 20, the appendages 40*d* and 41*g* define an electrical-connector body, which houses the portion 25*c* of the circuit arrangement 25 on which the connector 26 is coupled (see, for reference, FIG. 10 or FIG. 18, in which a part of the wiring for connection to the supply device PSD of FIGS. 7 and 8 is also visible). The portion 25*c* and/or the corresponding connector body 40*d*, 41*g*, on one side, and the connector 26, on the other side, may advantageously be provided with engagement means and/or polarization or encoding means in order to enable electrical coupling only with a predefined connector 26 and/or in a unique direction. The polarization or encoding means may, for example, comprise seats and/or cavities and/or holes made in the circuit board 25*a* and/or in the connector 25*c* and/or in the connector body 40*d*, 41*g*, designed to couple with respective polarization or encoding means of the connector 26. Likewise, the engagement means may, for example, comprise at least one tooth for engagement on the connector 26 and a corresponding seat for engagement on the circuit board 25*a* and/or the connector 25*c* and/or the corresponding connector body, or vice versa.

In the embodiment illustrated, the connector appendages or portions 40*d* and 41*g* define at least one of engagement means and polarization means, for unique coupling with the predefined connector 26. More in particular, the appendage 41*g* includes a tooth (see, for example, FIG. 15) designed to couple in a corresponding seat of the body of the connector 26, whereas the appendage 40*d* has an insertion "key" comprising reliefs and cavities (partially visible in FIG. 14), for coupling with a respective substantially complementary part of the connector 26.

The connector 26 is preferably provided with elastic electrical terminals or connections, designed to contact the respective electrical terminals of the connector 25*c*, which are preferably made in the form of electrical tracks on the circuit board 25*a*, but could also be constituted by rigid metal terminals. The connection of the connector 26 to the corresponding wiring may, for example, be obtained by insulator-punchthrough connection means.

In the example of embodiment provided, the ring nut 22 has an axial cavity, in which there may be received a corresponding part of the gas tap, preferably comprising at least part of the rod 11. The ring nut 22 has a gripping portion 22*a*, which is preferably provided on the surface with knurling or the like. The outer profile of the gripping portion 22*a* is preferably substantially frustoconical, with major diameter on its face opposite to the wall 3*a* of the appliance, and in particular with an inclination of its peripheral wall $\mathbf{22}_1$ substantially of 45°. Preferably, moreover, at the upper end of the axial cavity of the ring nut, the gripping portion 22*a* defines an inclined annular wall $\mathbf{22}_2$, in particular with an inclination substantially of 45° and opposite to that of the external peripheral wall $\mathbf{22}_1$.

On the opposite face of the portion 22*a* a seat 22*b* is defined for the sealing element 31, which is preferably an annular gasket, of an O-ring type. In the condition where the device 20 is installed, the element 31 is designed to cooperate in a sealed way with the front surface of the wall 3*a* of the appliance.

Figure 18:
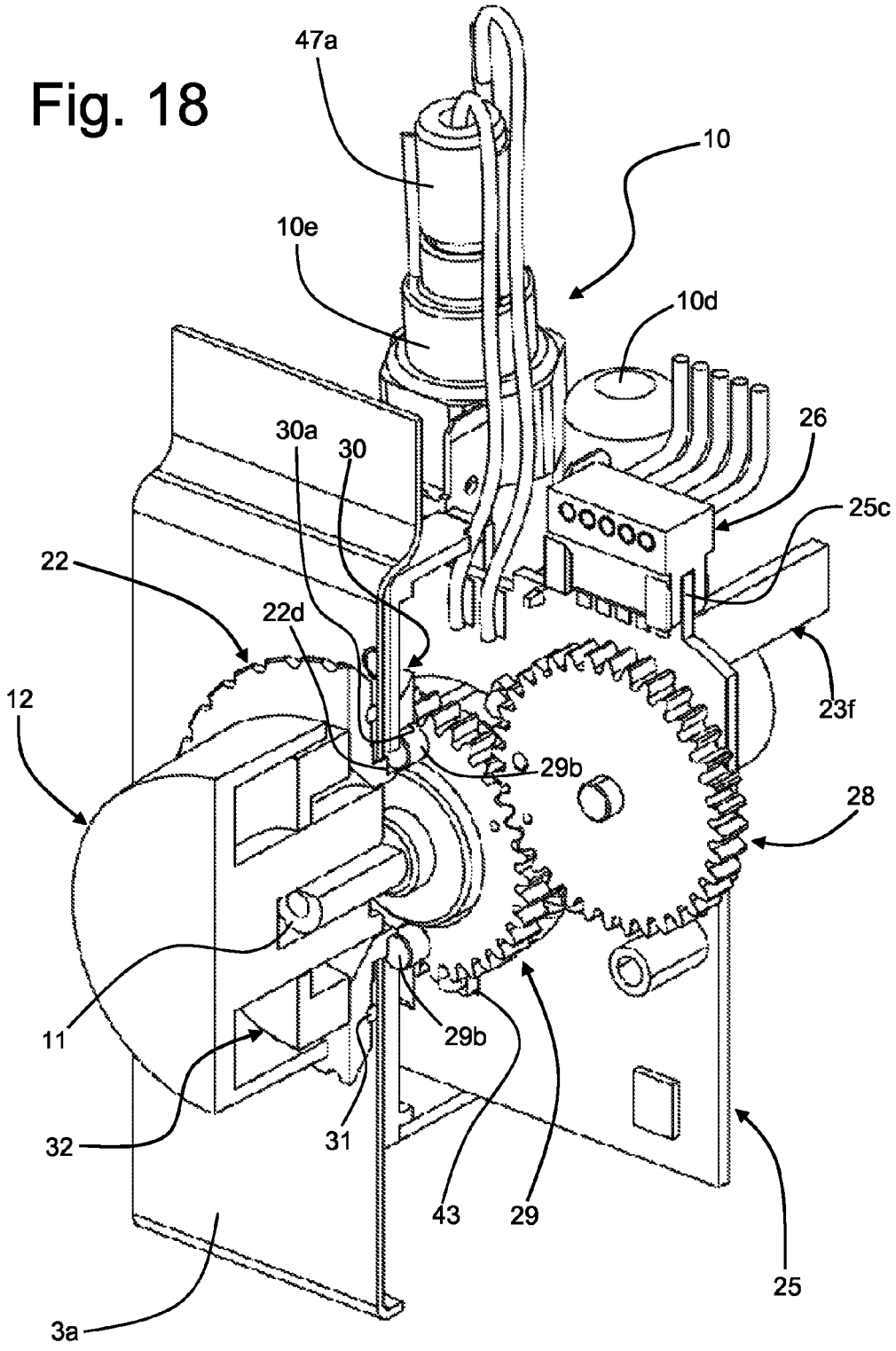
FIG. 18 is a perspective view of the same type as that of FIG. 9, but rotated and partially sectioned.

Rising from the lower face of the gripping portion 22*a* is a cylindrical hollow portion 22*c*, on the outer surface of which seats 22*d* are defined, in the form of axial recesses, having a shape at least in part complementary to the outer profile of the engagement elements 29*b* of the toothed member 29 in order to obtain mutual coupling between them that enables transmission of a rotation of the ring nut 22 to the member 29, as may be seen, for example, in FIG. 18. In the example of embodiment illustrated, then, at least two seats 22*d* are provided, in diametrally opposite positions, preferably having a substantially semi-cylindrical profile. In general, then, the seats 30*a* of the intermediate member 30 and the seats 22*d* of the ring nut 22, in the form of axial recesses, are preferably such as to couple to one another or face each another so as to provide seats of a shape substantially complementary to the outer profile of the respective engagement elements 29*b* of the rotating member 29, in particular, seats having a substantially cylindrical profile.

Preferably, the outer diameter of the cylindrical portion 22*c* is smaller than the diameter of the opening 7 provided on the wall 3*a* of the appliance and only slightly smaller than the diameter of the opening 41*b* of the lid, in such a way that the ring nut 22 can be turned manually. The outer diameter of the cylindrical portion 22*c* is also slightly smaller than the diameter of the axial cavity of the member 30 so that it can be inserted therein, with the corresponding seats 22*d* that fit on the part of the engagement elements 29*b* opposite to the part that is engaged in the seats 30*a* of the member 30, as may be appreciated, for example, from FIG. 18. Consequently, the arrangement is such that a rotation imparted manually on the ring nut 22 is transmitted both to the toothed member 29 and to the intermediate member 30, given the coupling of the elements 29*b* of the member 29 with the seats 30*a* and 22*d* of the member 30 and of the ring nut 22, respectively. Rotation of the member 29 then brings about rotation of the member 28, with the shaft 28*b*, and thus variation of the adjustment value of the potentiometer 44.

The intermediate element 32 also has a generally annular shape and is provided for being operatively mounted between the ring nut 22 and the knob 12, preferably at least partially in a concealed position, as may be seen for example in FIG. 18. It may be noted that intermediate elements similar to the element 32 are normally provided in knobs for gas taps, on the aforesaid known intermediate elements there being mounted an annular gasket, designed to operate in a sealed way on the outer surface of the appliance. In a preferred embodiment, the element 32 is pushed by a spring 32*a* (not represented) mounted inside the knob 12, in order to press the ring nut 22 towards the surface 3*a* of the appliance: in this way, the sealing element 31 of the ring nut 22 is pushed against the surface 3*a*.

In the example represented, the knob 12 of the tap 10 has a main part that includes a cylindrical wall 12*a* and an upper closing wall 12*b*, extending from a lower face of which is a cylindrical shank 12*c*, substantially coaxial to the wall 12*a*. Defined in the shank 12*c* is an axial seat 12*d* for receiving and engaging the rod 11 of the tap 10, with a coupling such that a rotation imparted on the knob 12 will cause rotation of the rod 11. The diameter of the axial passage of the intermediate element 32 is slightly greater than that of the shank 12*c*, whereas the outer diameter of the element 32 is only slightly smaller than the inner diameter of the cylindrical wall 12*a* of the knob. In this way, the knob 12 can also be pressed to enable axial sliding of the rod 11 of the tap 10, with the knob itself that can slide on the element 32, the latter resting on the ring nut 22.

It goes without saying that the inner diameter of the axial passage of the ring nut 22 is only slightly greater than that of the shank 12*c* of the knob 12 and that the inner diameters of the axial passages of the members 29 and 30 are such as to enable insertion through them of the head portion 10*a* (FIGS. 11-12) of the tap 10, which also passes through the openings 42 and 40*b* of the container 40 and of the lid 41 of the casing 21.

FIG. 17 represents a condition of partial assembly of the timer device, visible in which is the container 40 within which the circuit arrangement is located, as well as the toothed transmission members 28 and 29 and the intermediate member 30. The transmission arrangement described, thanks to the axial cavities of the members 29 and 30, enables adequate shielding of the inside of the casing 21, even in the case of removal of the ring nut 22.

FIG. 18 illustrates the device 20 in partial cross section, this figure also showing the transmission arrangement formed by the members 28-30 coupled together by means of the elements 29*b* of the member 29, as well as the gasket 31 set between the ring nut 22 and the front surface of the wall 3*a*.

As already clarified, the device 20 is preferably prearranged for performing at least a function of timing of the supply of gas to the burner controlled by the tap 10, and includes for this purpose at least a timer circuit and a means for manual setting of the supply interval, here represented by the ring nut 22, which can be operated from the outside of the structure of the appliance and is substantially coaxial to the knob 12 of the tap 10. In one embodiment, such as the one described previously, the knob 12 and the ring nut 22 can be turned by a user, preferably independently of one another, about the axis A, in order to enable, on the one hand, adjustment of the flow of gas admitted to the burner and, on the other hand, setting of the time of supply of the burner. The knob 12 is also axially movable, unlike the ring nut 22 (on the other hand, as has been mentioned, in possible variant embodiments also the ring nut 22 could translate axially).

As represented schematically in FIG. 19, the timer circuit MC is implemented in the circuit arrangement 25, which likewise includes first switching means Q1, which can be controlled for causing interruption of electrical supply to the electromagnet EM of the safety valve of the tap 10, upon expiry of the time interval set via the ring nut 22, and thus cause passage of the aforesaid valve into the respective closed condition. For this purpose, the first switching means Q1 are preferably connected in series between the thermocouple TC provided for the tap 10 and the electromagnet EM of the corresponding safety valve.

The timer circuit MC can be obtained in any known way, for example including, in the circuit arrangement 25, a commercially available microcontroller provided with clock or timer function, which can be supplied with a low d.c. voltage (for example 3-12 Vdc) via a supply stage or stabilized power supply, which receives a.c. voltage from the supply device PSD of FIG. 7 or FIG. 8. Hence, the device 20 is preferably a low-voltage device. The aforesaid microcontroller MC, in which the program or software for control of the device can be implemented, is connected in signal communication to the position-sensor means, here represented by the potentiometer 44, from which the information regarding the time interval set is obtained.

The first switching means Q1 preferably include at least one switch that can be controlled for opening or varying the electrical circuit of the thermocouple TC, when the time interval in which the burner 5*a* is to remain lit set via the ring nut 22 has elapsed. The controllable switch may be of an electro-mechanical type, for example a relay, or else of an electronic type, for example a MOSFET, and is preferably, but not necessarily, of a normally open type, switchable via a pulse or signal governed by the timer circuit MC. In a preferred embodiment, the switch Q1 is an electronic switch, in particular a MOSFET with extremely low channel resistance, set in series to the thermocouple TC-electromagnet EM circuit. A switch of this sort guarantees, in the case of conduction, an extremely low resistance of the circuit and enables requirements of miniaturization to be met.

According to possible variants, the switching means may include a device or circuit configured for varying the electrical circuit of the thermocouple, for example a load (such as a resistance), which, when rendered active, reduces the current to the electromagnet EM.

As has been said, in a preferred, albeit non-exclusive, embodiment of the invention, the device 20 is also prearranged for the purposes of control of a lighter system. The circuit part regarding the lighter system, and, in particular, its module IS, can be obtained in any known way, and is not necessarily implemented in the circuit arrangement 25. In one embodiment, the power stage ISC for control of the lighter module IS of FIGS. 7 and 8 includes corresponding control means, which may comprise, for example, a corresponding controllable switch, such as a relay, or a MOSFET, or an opto-triac. As has been said, such a power switch may be switchable following by a pulse or signal generated by the arrangement 25, as denoted by the reference ISCS of FIGS. 7 and 8.

The potentiometer 44, or other component that stands in for it, basically has the function of detecting the position, among a plurality of possible positions, assumed by the manual-control means represented by the ring nut 22, this position representing the duration of the time interval set. As has been said, in a preferred embodiment, the stationary component 44 is constituted by a rotary potentiometer, in particular of a resistive type, preferably of the type designed to be mounted and/or welded directly on a circuit board 25*a*, such as a trimmer, but its functions may be evidently obtained via other electrical and/or electronic components, such as for example optical or magnetic encoders and sensors. The person skilled in the art will hence appreciate that the movable part of the sensor means do not necessarily have to be represented by a rotary shaft, such as the shaft 28*b*, it being possible to obtain it with some other type of movable element.

In the example of embodiment considered herein, the connector 25*c* of the device 20 is with five contacts, for interconnection with the supply device PSD in a remote position on the appliance 1, especially via the connector 26.

The corresponding five lines, numbered in FIG. 19 from L1 to L5, correspond to the following signals/circuits:

L1: 12-Vdc supply, for supply of the circuit arrangement 25;

L2: driving of buzzer circuit BC; this is, in particular, a signal issued by the microcontroller MC of the device 20 for driving the warning circuit BC of the device PSD, such as an electrical signal corresponding to the waveform of an acoustic signal;

L3: control of sharing of buzzer circuit BC, which enables shared management of the warning circuit BC of the device PSD between a number of devices 20;

L4: control stage ISC of the lighter;

L5: ground, which represents the zero of the supply and the reference for the other signals.

Connection to the electromagnet EM of the safety valve of the tap is directly obtained via the conductors 47, connected or welded on the circuit board 25, and having at the other end the purposely provided connector 47*a*. Respectively connected to the contacts 25*d*– and 25*d*+ are the negative pole of the thermocouple (for example, with a conductor not necessarily protected by an insulator), internally connected to ground, and the positive pole of the thermocouple (for example, the conductor protected by an insulator).

FIG. 20 illustrates, via a simplified block diagram, a possible architecture of the supply device PSD. This device, which preferably comprises a separate and single card, provides, as has been said, the common resources to the system. Its main purpose is to generate a low-voltage supply (in the example, the d.c. supply voltage is of approximately 10 Vdc) for the devices 20, via the stage F. Advantageously, the device PSD then includes at least one of the stages ISC and BC. The device PSD preferably comprises a casing of its own, mounted on the appliance 1 in a remote position with respect to the devices 20 and to the taps 10. This casing (not illustrated in the figures since it may have any shape designed for the purpose) is preferably made at least in part of an electrically conductive material and includes means for interconnection to the 220-Vac mains supply and to the devices 20.

In one embodiment, present on the supply device PSD is a connector CD, preferably similar to the connector 25*c* of the various devices 20, which keeps the same arrangement of the signals. Connected to this connector CD are the wiring systems provided for corresponding devices 20, each of the wiring systems terminating with a respective connector 26 (one of these wiring systems is visible in FIG. 18, not indicated, coupled to the corresponding connector 26). In one embodiment, then, supply and control signals are distributed between the devices PSD and 20 via cables with five conductors, for example with daisy-chain configuration, where two conductors (L1 and L5) are dedicated to the supply, two conductors (L2 and L3) are dedicated to driving and control of sharing of the warning circuit BC, respectively, and one conductor (L4) is dedicated to control of the lighter module IS. The device PSD then includes at least three contacts J2, J3 and J4, for example blade contacts, in particular of a Faston type. The contacts J2 and J3 constitute the 220-Vac mains-supply input, whereas the contacts 32 and J4 constitute the connection to the lighter module IS.

Figure 21:
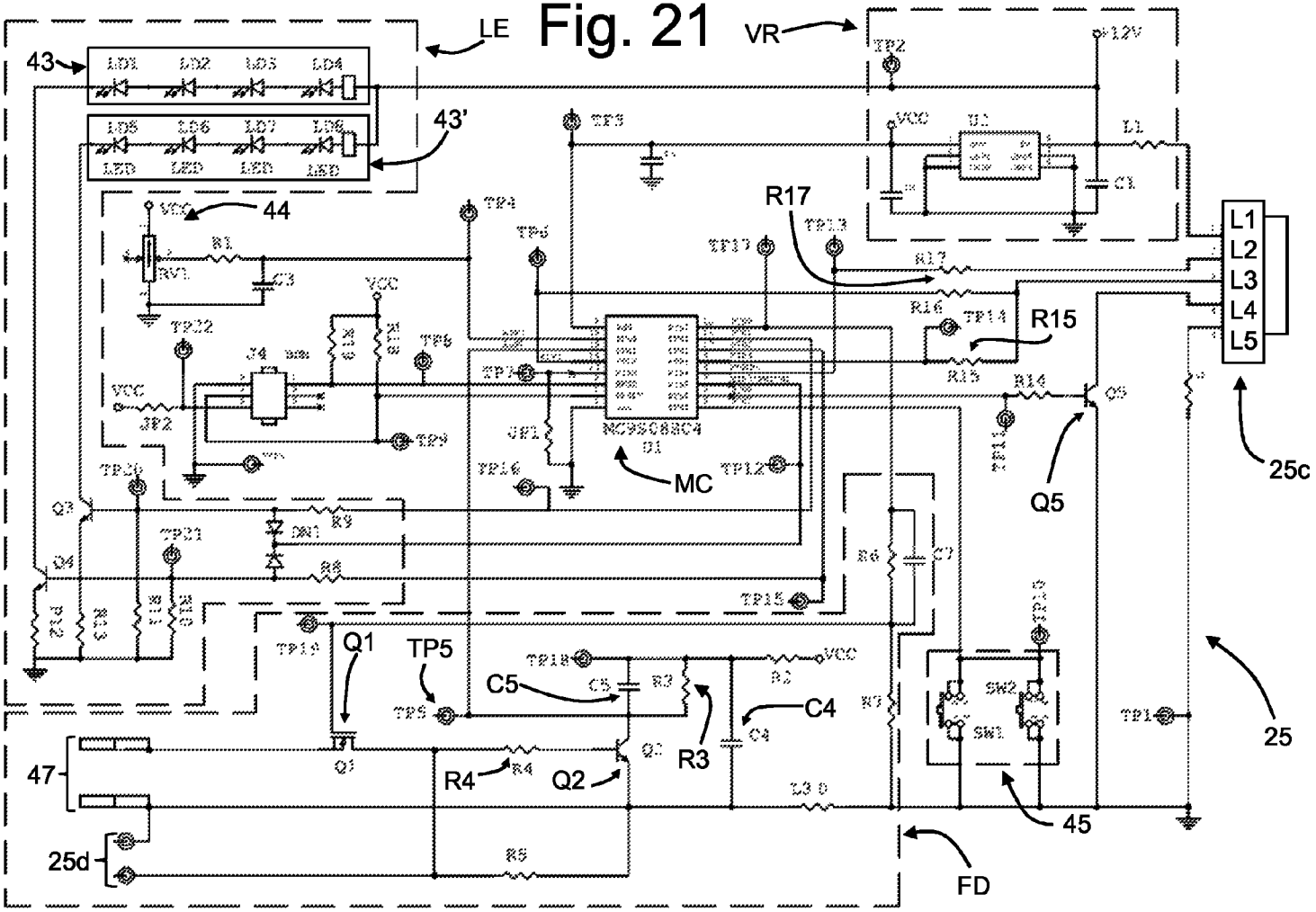
FIG. 21 is a detailed diagram of a possible embodiment of the circuit arrangement of FIG. 19.
Figure 22:
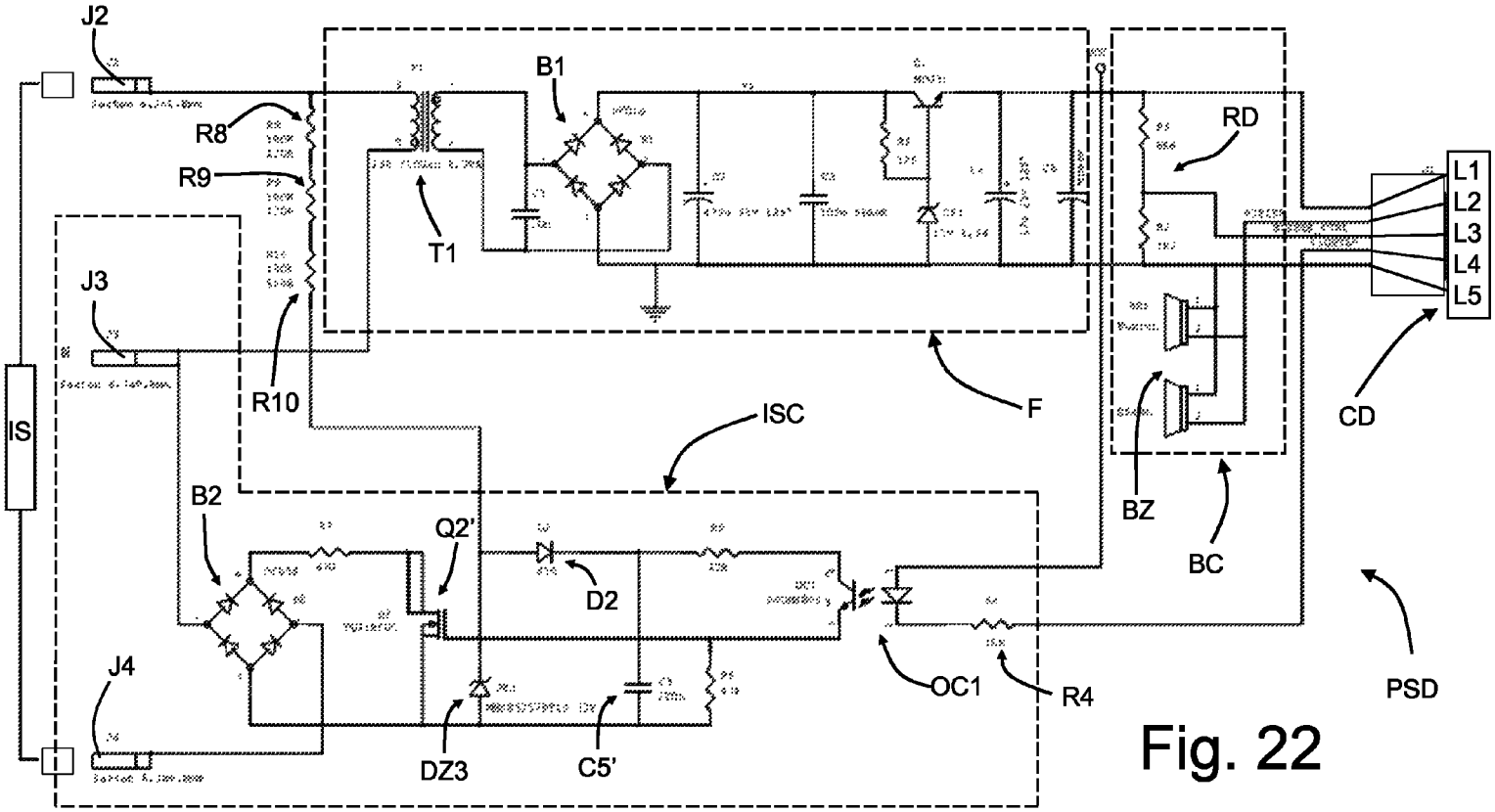
FIG. 22 is a detailed diagram of a possible embodiment of the supply arrangement of FIG. 20.

FIGS. 21 and 22 illustrate possible detailed diagrams of the circuit arrangement 25 of a device 20 and of the supply device PSD. A detailed description of the circuits is not provided, given that they can be obtained in ways different from the ones represented to implement the function explained herein. The diagrams are in any case in themselves clear to a person skilled in the branch. In what follows only the general functions of the stages/circuits indicated will hence be summarized, as well as some of their innovative peculiarities.

With particular reference to FIG. 21, and as has already been seen, the arrangement 25 is preferably equipped with a microcontroller circuit MC, implemented in which is the control software (finite-state machine). The microcontroller MC governs the following circuits/components:

- circuit for detecting the position of the ring nut 22, including the resistive sensor 44, the value of which is read by an internal A/D converter of the microcontroller MC;
- circuit for driving the stage BC of the device PSD, coming under the line L2 and comprising a tone generator, implemented directly in the microcontroller MC; this circuit directly drives a buzzer BZ of the stage BC via one of its own digital outputs; in one embodiment, the signal is a square wave comprised between 0 and 5 Vdc with a frequency of between 2 and 4 kHz; in the example represented, the impedance of the generator is 1 kΩ (resistance R17);
- circuit for control of sharing of the stage BC, coming under the line L3; this circuit includes an analog input and a digital output of the microcontroller MC; the supply stage F of the device PSD supplies in a static way the line L3with a resistive divider (RD, FIG. 22) connected between +12 Vdc and ground (line L5); the line L3 is hence stably connected to an equivalent generator of approximately 2.5 Vdc with a series resistance of approximately 1.7 kΩ; the devices 20 interface the line L3 with a resistance R15 of 1 kΩ, connected to a pin of the microcontroller (9—PTB3): in the condition of quiescence, the microcontroller MC keeps this pin at high impedance; the mechanism with which this signal is handled will be described hereinafter; as will be seen, the line L3 is of an analog type, with a voltage value comprised between 0 and 5 Vdc and with minimum impedance of a few hundreds of ohms;

light-emitter circuit LE: an output of the microcontroller MC is dedicated to driving the emitters 43, for example of the red LEDs; in a possible variant, a second output of the microcontroller MC is able to drive optionally a further series of emitters of a different colour, for example green (designated by 43' only in FIG. 21).

electronic switch Q1 of the thermocouple TC-electromagnet EM circuit, where the switch, as has been said, is preferably constituted by a MOSFET;

flame-detecting circuit, designated in FIG. 21 by FD; this circuit is configured for detecting the flow of current in the thermocouple TC-electromagnet EM circuit (current indicatively≥100 mA); the principle is preferably based upon detection of the overvoltages that are generated across the electromagnet EM following upon sharp interruptions of the circulating current; the MOSFET Q1 itself responsible for interruption of the current upon expiry of the time programmed is driven so as to open the circuit periodically for an extremely short time (for example, a few microseconds every 10 ms); in the presence of sufficient current (≥100 mA), immediately after interruption of the current in the electromagnet EM, the presence of a variation of voltage or an overvoltage brings about charging of a capacitor C5, the voltage across which is measured by a converter A of the microcontroller MC; the extremely short periodic interruption of current is such as to not cause tripping of the safety valve of the tap; the presence of the aforesaid voltage variation or overvoltage is hence indicative of the fact that, upon the extremely short interruption, the thermocouple TC generates an e.m.f. and hence the flame is present;

circuit for detection of the pressure applied on the knob 12 of the tap 10—via the switch 45, here of a double-throw type, connected to a digital input of the microcontroller MC;

circuit for driving the stage ISC of the supply device PSD, via a digital output of the microcontroller MC coming under the line L4; the devices 20 give out onto this line with open-collector transistor in parallel (Q5); on the other side, the device PSD provides a pull-up resistance connected to the 12-Vdc supply (R4—10 kΩ, FIG. 22); following upon the usual manoeuvre of pressing the knob 12 of the tap 10, the motion-transmission element 27 of the device 20 acts on the switch 45, causing closing thereof; switching of the switch 45 may have different meanings, according to the context, as will emerge clearly hereinafter; generally, switching of the switch 45 is interpreted by the control logic as start of a control sequence; activation of the lighter module IS effectively takes place only if, after the button of the switch 45 has been pressed, there does not follow within a given time (for example, 2 s), a second manoeuvre on any other control member, for example, the ring nut 22, in general, then, a simple pressure applied on the knob 12, with consequent switching of the switch 45 produces activation of the lighter module IS only after a predefined time, for example a couple of seconds;

autonomous voltage-adjustment circuit, designated by VR, which generates, starting from the voltage supplied by the stage F of the device PSD, the voltage necessary for supply of the microcontroller MC; as has been said, in the example, the stage F generates a voltage of approximately 12 Vdc, whereas the voltage generated by the voltage-regulator circuit VR is 5 Vdc; the emitters 43 (and possibly 43') are directly supplied by the semi-regulated voltage supplied via the stage F of the device PSD.

In a preferred embodiment, operation of the flame-detecting circuit FD is the following. By interrupting suddenly the current in the circuit formed by thermocouple and the coil of the safety valve—if current is circulating in this circuit—a self-induced e.m.f. is generated across the coil. The MOSFET Q1 is thus temporarily opened (for a few microseconds every 10 ms). When Q1 opens, the self-induced e.m.f. generates a current between the base and the emitter of the transistor Q2. Q2 goes into in saturation, charging the capacitor C5 and sending the node TP5 to a voltage value close to 0 (normally, this node is at 5 V). The microcontroller MC, after opening Q1, carries out immediately a voltage reading on the node TP5 and verifies that the voltage value is lower than a certain threshold. Preferably, a resistance R3 is provided for discharging C5 after Q1 has reclosed the thermocouple-coil circuit and bringing the node TP5 back again to 5 V. Once again preferably, a capacitor C4 is provided that functions as charge tank for C5, as well as a resistance R2 for recharging C4, limiting the impulsive current absorbed by the entire circuit. A resistance R5 may be used for limiting the self-induced voltage upon opening of the thermocouple-coil circuit and regulates the sensitivity of the circuit.

In a possible alternative embodiment (not illustrated), the circuit FD is once again based upon the opening of the MOSFET Q1. When Q1 opens, the thermocouple is disconnected. By measuring the voltage on the thermocouple a difference in voltage should be noted. Consequently, in practice i) the thermocouple voltage is measured prior to opening of Q1;

ii) Q1 opens;

iii) the measurement is repeated; and iv) it is verified whether there exists a substantial difference between the two measurements.

In order to measure these voltages (which are of the order of millivolts) it is possible to use a high-gain amplifier, for example obtained with just one transistor d.c.-uncoupled from the input by means of a capacitor.

In the circuit arrangement 25 of the example illustrated no use is made of hardware interrupts. An internal timer of the microcontroller MC is programmed for generating a software interrupt every 10 ms. The routine for managing said interrupt performs one or more of the following operations:

1) management and increment of the main system clock that determines the time of gas supply of the burner coming under it;

2) management and increment of the counters that determine wait times and time-outs on which operation of the control algorithms is based;

3) management of the emitters 43 (on, off, or flashing);

4) basic management of the buzzer BZ (off, constant sound, or intermittent sound);

5) management of the pushbutton switch 45: detection of the pressure exerted thereon and "anti-rebound" filtering of the contact;

6) management of the flame-detection circuit FD, periodic measurement of the voltage on the detection circuit, and filtering (more than one confirmation of the state of the flame are preferably required prior to communication to the program for management of said event).

The microcontroller MC is preferably provided with an automatic-control mechanism or watchdog so that, in the case of loss of control by the software implemented therein, irrespective of the cause, it is able to reset itself, i.e., restart operation of the program automatically. Consequent re-initialization of the device 20 in any case brings about automatic extinction of the flame, in particular, for safety purposes.

In the software implemented in the microcontroller MC there may be envisaged a safety function, whereby, following upon ignition of the flame, the device 20 starts in any case a timed-extinction cycle: in this case, the user is required to program the device 20 by setting a precise cooking time rather than to disable the device itself voluntarily.

Coming now to FIG. 22, the stage F includes a transformer T1, a corresponding rectifier bridge B1, passive components (such as capacitors, diodes, resistors), and active components (such as transistors or integrated circuits) designed to provide a stabilized power supply. This stage basically has the purpose of generating the d.c. supply voltage (approximately 10 Vdc nominal and 12 Vdc maximum) that is semi-regulated (obtained a circuit for voltage limitation and stabilization is basically).

The stage ISC of the supply device PSD basically provides an electrical interface circuit towards the lighter module IS, which includes at least one electronic switch. In the example represented, the stage ISC includes an electrical-separation or insulation device OC1, for example a photo-coupler (or optotransistor or opto-triac), in particular, for separating and/or insulating the device 20 electrically with respect to the lighter IS, i.e., separate low-voltage circuits or signals (e.g., at 5 or 12 Vdc) from higher-voltage circuits or signals (e.g., 220 Vac). The open-collector outputs of the various devices 20 (line L4), in particular set in "wired-or" configuration, on a single electrical line, are able to activate the photo-coupler OC1, which functions as switch for the mains-voltage line (220 Vac) that supplies the module IS with which the appliance is equipped.

The choice of a photo-coupler (or optotransistor or opto-triac) is even more advantageous in so far as it can be activated even at the low absorption currents of lighters normally used on cooking appliances (typically, 1 VA, 5 mA).

In the example represented, the photo-coupler OC1, which has a transistor output designed to work at low voltages, drives a high-voltage MOSFET Q2'. The diode bridge, designated by B2, is used for presenting to the MOSFET Q2' a voltage that is always positive. The network constituted by the resistors R8-R10, the diodes D2 and DZ3, and the capacitor C5', is used for supplying the photo-coupler OC1 and for supplying the d.c. voltage sufficient for driving the MOSFET Q2'.

The warning circuit BC of the device PSD contains at least one buzzer BZ, which can be managed in the way described in what follows.

The line L2 connects in parallel all the corresponding outputs of the individual devices 20. Normally, the single microcontroller MC keeps this output open (three-state). The line L3 shared in parallel is, instead, used for carrying out a rough management of conflicts and/or precedences between devices 20 that simultaneously need to use the buzzer BZ. More in particular, the device PSD has—here in the context of the stage BC—a voltage-reference generator, represented by the resistive divider designated by RD, for example at approximately 2.5 Vdc with an impedance of 1.7 kΩ. This reference is distributed in parallel on the line L3 to all the devices 20. Each device 20 is able to measure the voltage on the line L3 and to insert a resistance R15 (in the example having a value of 1 kΩ towards the supply voltage of the microcontroller MC (+5 Vdc) or towards 0 Vdc (ground), thus varying the voltage level on the line L3. This line is hence of an analog type, with a voltage value comprised between 0 V and 5 V and minimum impedance of a few hundreds of ohms.

The individual device 20 that needs to issue a sound by means of the shared buzzer BZ of the stage BC monitors the state of the line L3 via the corresponding input A of the microcontroller MC.

For a range of voltages around the one generated by the divider RD (2.5 Vdc) the buzzer BZ is found to be free, and the device 20 can use the line L2. To generate its own buzz or beep, the device occupies the line L3, connecting the resistance R15 to 0 Vdc or 5 Vdc, altering the voltage of the line itself. The connection to 0 Vdc is made if the beep to be issued is short and deemed a priority. In these conditions, no other device can interrupt this sound emission. The line L3 goes to approximately 0.5 Vdc. The connection to 5 Vdc is made, instead, if the beep to be emitted is long and hence not deemed a priority, therefore interruptable. The line L3 goes to approximately 4 Vdc. At the end of the buzz or beep, the resistance R15 is disconnected and the line L3 returns to the value of 2.5 Vdc. Consequently, for the range of voltages higher than the one generated by the divider RD (2.5 Vdc), the buzzer is occupied, but only for long beeps; i.e., it can be interrupted by short beeps.

For values lower than said range of voltages, the buzzer is occupied by short beeps that cannot be interrupted.

In the case where a second device 20 intends to issue a beep, its microcontroller checks, as does that of the first device 20, the state of the line L3. If the line L3 is found at values close to 0.5 Vdc, the microcontroller MC understands that the buzzer BZ is occupied and hence waits for the end of the sound emission in progress (short beeps). The end is determined as soon as the voltage on the line L3 goes back to 2.5 Vdc. If, instead, the line L3 is found to be at approximately 4 Vdc, the microcontroller MC of the second device 20 understands that long beeps are being issued. In this case, if the beep to be emitted is short and hence a priority beep, the second device 20 connects its own resistance R15 to ground. The first device 20 recognizes this condition on the line L3, interrupting its own sound emission and leaving the buzzer BZ free for the second device 20. As may be seen, via the line L3 there is basically applied a simple protocol that manages and/or prevents any possible conflicts on the buzzer BZ between the different devices 20.

In one embodiment, the general principle according to which a first device 20 decides to emit a sound via the buzzer is hence the following:

if the buzzer BZ is free, the beep is immediately emitted;

if the buzzer BZ is already occupied by a prolonged sound emission (long beeps) from a second device 20, and only if the sound to be emitted is short (short beeps), the first device 20 alters the state of the control line L3 (voltage lower than 2.5 Vdc) thereby indicating to the second device 20 that it must interrupt its own sound emission. Next, the first device 20 takes over control of the buzzer BZ (line L2), emitting its own sound, and then restores the state of the line L3 so that the second device 20 will understand that it can proceed. If the second device 20 is occupying the buzzer BZ with a long beep and the first device 20 should also produce a long beep, the first device 20 exploits the sound emission in progress for as long as this may last, and then takes over control of the buzzer BZ and completes its own emission. In the case of two simultaneous short beeps, i.e., governed by the two different devices 20, these are in any case sequentialized.

Figure 23:
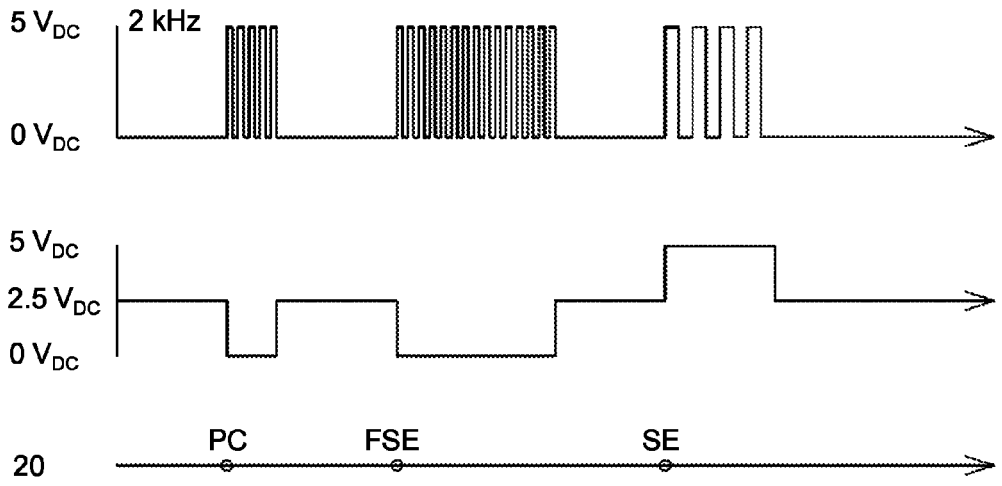
FIGS. 23-27 are schematic representations aimed at exemplifying possible situations of operation of a warning system of a device according to the invention.

FIG. 23 exemplifies the case of use of the buzzer BZ by just one timer device 20. The diagram in the upper part of the figure expresses the state of the line L2 for driving of the buzzer BZ on which the microcontroller MC generates a frequency-modulated signal (2-kHz modulation, in the example). Note that, for simplicity, the state of the line L2 is represented with signals in the high state, without the 2-kHz modulation being visible. In other words, to each small high pulse represented there corresponds in actual fact a train of pulses at 2 kHz. In these diagrams, as in the subsequent ones, the voltage is on the axis of the ordinates while the time is on the axis of the abscissae.

As has been seen, on the line L2 there may be generated two different tones, defined as "short beeps" and "long beeps", where substantially what varies is the time (period and half-period) in which the buzzer BZ is energized and de-energized.

The intermediate diagram in the figure expresses the state of the line L3 for controlling sharing of the buzzer BZ, for management of the acoustic-warning priorities. Like the line L2, the line L3 is common to all the devices 20 provided. To establish which device 20 is to transmit, i.e., which device has the highest priority, the line L3 is used. As explained previously, each device 20 detects the state of the line L3, which may be low or high with respect to an intermediate state, here by way of example, at 2.5 Vdc; i.e., there is a low state at 0 Vdc, a high state at 5 Vdc and a neutral state at 2.5 Vdc, where the low state defines the higher priority, whereas the high state indicates a lower priority. In the example, the sound warnings having higher priority (represented by short beeps) regard confirmation of programming PC and forewarning of end of supply FSE. The sound warning of lower priority (represented by long beeps) regards final interruption of supply SE. The aforesaid "short beeps" and "long beeps" may be kept active for a more or less long time in order to determine a different sound, which makes it possible to distinguish better one sound warning from another; in particular, for example with reference to FIG. 23, it is possible to note an forewarning of end of supply FSE kept active for a longer time than the warning for programming confirmation PC.

The diagram at the bottom indicates the typical steps of sound warning that the device 20 may issue, where PC is confirmation of programming, FSE is the forewarning of end of gas supply, and SE is the final interruption of the gas supply to the burner.

As has been said, a device 20 that detects a low priority on the line L3 (high signal at 5 Vdc) can "force" a low state of the line itself (at 0 Vdc) to let all the other devices 20 know that it has higher priority, and hence transmits its signal on the line 2, with the devices 20 that can detect this new state and behave accordingly, on the basis of their warning priority, for example suspending any possible transmission or modulation with lower priority.

Some possible cases of conflict are illustrated in FIGS. 24-27. These figures are similar to FIG. 23, but distinguished by two diagrams that indicate different steps of operation of two timer devices, designated by 20(*a*) and 20(*b*).

Figure 24:
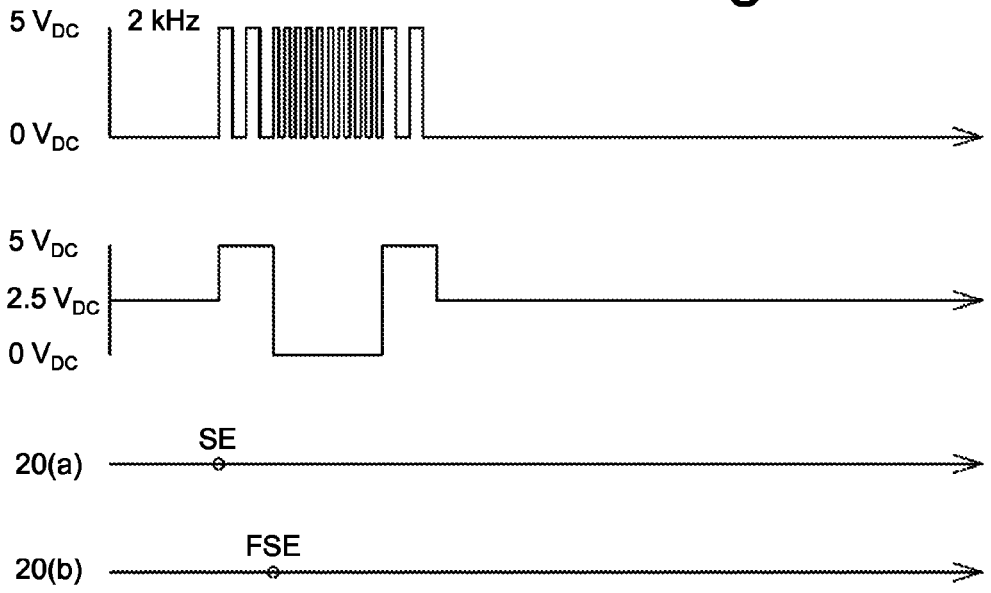

FIG. 24 illustrates the case where the device 20(*b*) asks to emit short beeps on the line L2 while the device 20(*a*) is emitting long beeps, forcing for this purpose the low state on the line L3.

Figure 25:
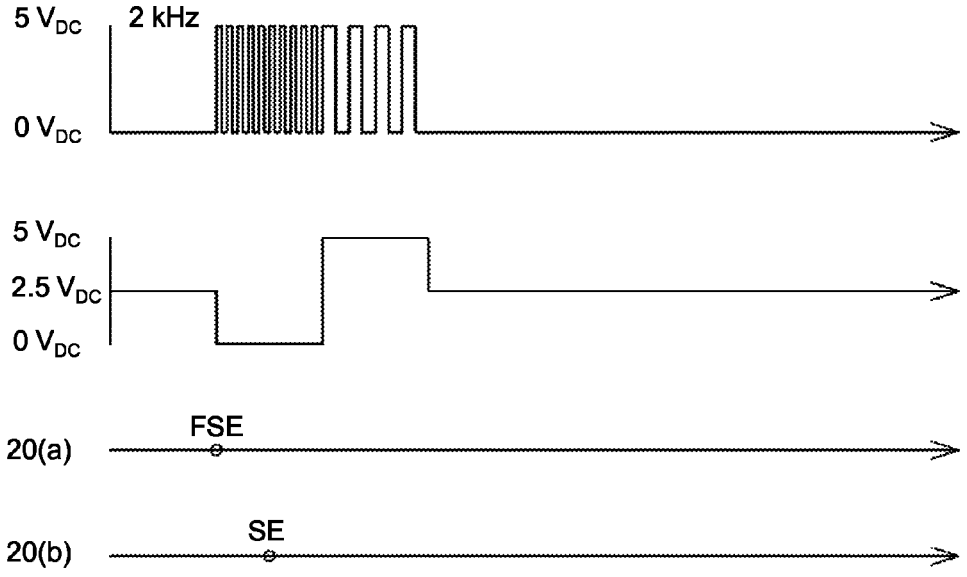

FIG. 25 illustrates the case where the device 20(*b*) asks to emit long beeps on the line 2 while the device 20(*a*) is emitting short beeps: in this case, the low state of the line L3 is forced by the device 20(*a*), with the device 20(*b*) that thus has to wait and tack its own acoustic warning on the end of the queue on the line L2.

Figure 26:
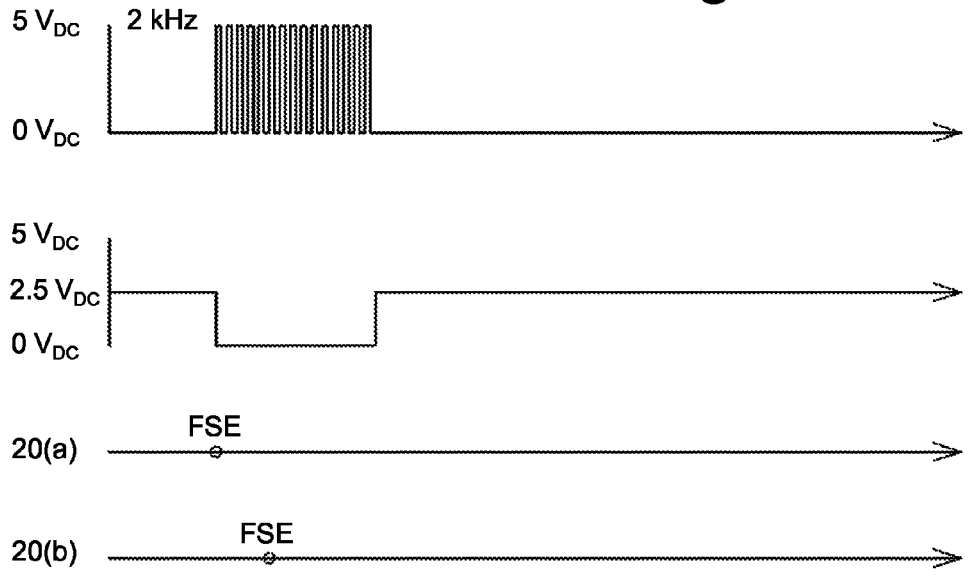

FIG. 26 illustrates the case where the device 20(*b*) asks to emit short beeps on the line L2 while the device 20(*a*) is already emitting short beeps in this case, there is basically a transmission of signals of the same sort on the line L2, i.e., a transmission of short beeps superimposed or else queued on the line L2, with the line L3 in the low state.

Figure 27:
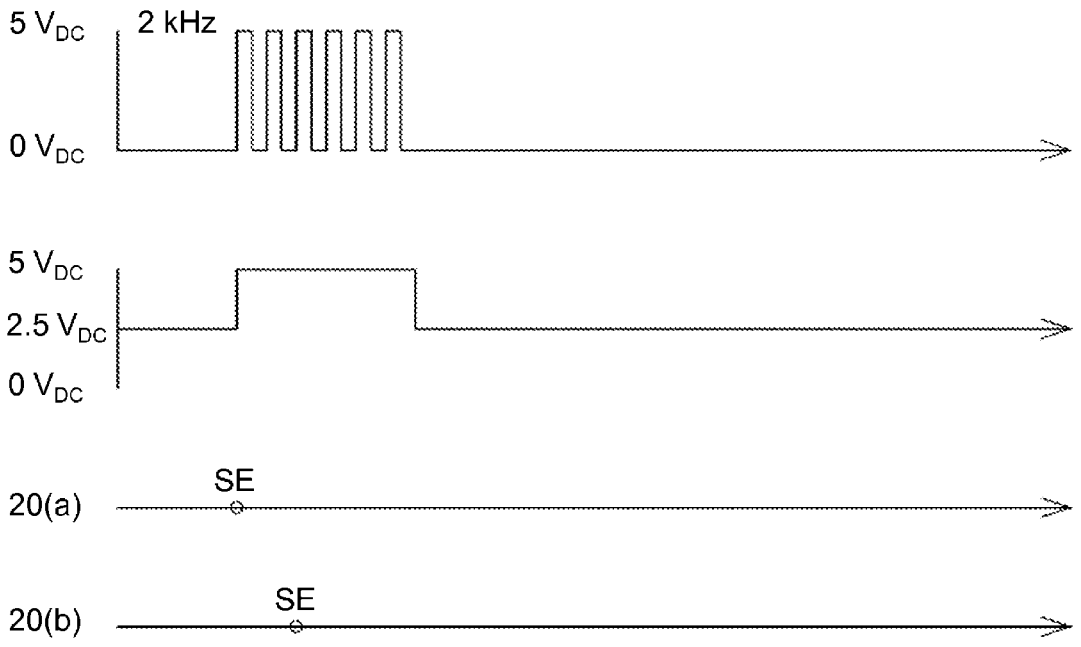

Likewise, FIG. 27 illustrates the case where the device 20(*b*) asks to emit long beeps on the line L2 while the device 20(*a*) is already emitting long beeps: also in this case, there is a transmission of signals of the same sort on the line L2, i.e., a transmission of long beeps superimposed or queued on the line L2, with the line L3 in the high state.

In the example previously described, the emitters 43, preferably distributed in a circle around the head portion of the tap 10, cause lighting-up of the ring nut 22, which is made of transparent plastic material, or in any case is designed to function as light guide. Also other mechanical parts for transmission of the rotational movement—at least the intermediate member 30 and preferably also the toothed member 29—are preferably made of a similar material, for example polycarbonate, to function as optical guide. In this way, the light generated by the emitters 43 is visible from outside the casing 21. The light warnings, generated by the emitters 43 under the control of the timer circuit MC, are useful for a user of the device 20. For example:

- a rapidly flashing light may be used to indicate that the device is awaiting programming of the time of supply of the burner;
- a light that stays on may be used to indicate that the device 20 has not been programmed;
- a slowly flashing light may be used to indicate that the device has been programmed and that a cycle of automatic extinction is in progress;
- a rapidly flashing light may be used to indicate that the end of the supply time is near, and that the flame will be turned off within a very short time.

As already mentioned, in addition or as an alternative, there may also be provided warning means of some other type, for example of an acoustic type, such as the buzzer BZ. In such a case, for example, different acoustic signals may indicate different events, such as confirmation of programming, approach of expiry of the supply time set, effective end of the supply time set.

The control element, here represented by the switch 45, of the circuit arrangement 25 basically has the function of generating the command signal that the microcontroller circuit MC handles for determining or controlling initial closing of the switch Q1 and start-up or otherwise of a time count. The signal generated by the switch 45 can also be used by the arrangement 25, and, in particular, by its microcontroller MC, for generating the switching pulse of the control means associated to the circuit of the lighter system.

Assembly of the device 20 is very simple. Once the casing 21 has been assembled on the bracket 23, the latter is fixed to the body of the corresponding tap 10, already mounted on the part 2 of the structure of the appliance 1. The head portion 10*a* of the tap is thus inserted in the through opening of the casing 21, with the actuation element 10*f* of the tap that is located in a position corresponding to the recess 42*b* of the container 40, coupled to the motion-transmission element 27 of the device 20.

The connector 47*a* is connected to the corresponding attachment 10*e* of the tap, whereas the conductors of the thermocouple TC are connected to the blade contacts 25*d*. After assembly of the part 3 of the structure of the appliance 1, the ring nut 22 is fitted through the through opening 7 of the wall 3*a* of the structure so that its cylindrical lower portion 22*c* is inserted in the toothed member 29, thus obtaining also coupling between the engagement elements 29*b* and the seats 22*d*. Then coupled to the stem 11 of the tap is the knob 12, on the shank 12*c* of which the element 32 has been previously fitted. The coupling between the stem 11 and the shank 12*c* is configured for enabling removal of the knob 12 and of the ring nut 22 itself by the user, for example for cleaning.

General operation of the device may be at least in part similar to the one described in the document No. WO 2010/134040, to which the reader is referred. In brief, for the purposes of programming of a desired time interval in which the burner is to remain lit, the user has to turn the ring nut 22 for setting the desired time, for example ranging between 1 and 120 minutes. The user then turns the knob 12 and presses it in order to bring about initial opening of the safety valve and activation of the gas lighter. The pressure exerted on the knob 12 causes axial displacement of the stem 11 and of the actuation element 10*f*, and hence movement of the motion-transmission element 27, with consequent switching of the control element represented by the switch 45. The signal generated by the switch 45 is used by the control logic of the device 20 for controlling closing of the switching means Q1 provided on the circuit arrangement 25, connected in series between the thermocouple TC and the electromagnet EM of the safety valve, in order to start counting of the time and generate the command signal of the switch associated to the lighter system, when this function is envisaged. Once the burner 5*a* has been lit, the heat generated by the flame causes the thermocouple TC to generate the current necessary to keep the safety valve of the tap 10 open. At the end of the time interval set via the ring nut 22, the control logic generates a new signal of switching of the switching means Q1, which in this way open the circuit of the electromagnet EM, with consequent closing of the safety valve of the tap 1. The burner is thus turned off once the pre-set time has elapsed.

The device 20 preferably has a predefined position of non-intervention in order to enable normal use of the tap 10 and of the corresponding burner without activation of the timing function. This position may conveniently be represented by an angular position of "zero" of the ring nut 22, which will be purposely provided with suitable indications. When the ring nut 22 is in this position, detected via the transmission arrangement 28-30 and the sensor 44, the functions of the circuit that are associated to the time count will not be active. However, pressure on the knob 12 will cause, in the ways already described above, generation of the signal that determines closing of the switching means in series between the thermocouple and the electromagnet in order to guarantee the electrical continuity necessary for opening the safety valve, and/or will cause generation of a signal for control of the lighter module.

In a different embodiment, the control logic of the device 20 envisages that programming will be carried out by the user after the flame to the burner 5*a* has already been lit. In this case, the user has to carry out lighting of the burner in the way described above (turn the knob 12 and press it, with consequent switching of the switch 45 and activation of the lighter system). Following upon ignition of the flame, the device 20 is activated in a programming mode, signalled, for example, by a fast flashing of the ring nut 22. Next, if within a given time interval the user does not turn the ring nut 22, the supply of gas proceeds in a traditional way (i.e., without timed turning-off), for example with the ring nut 22 lit up continuously via the emitters 43. Instead, in the case where it is desired to program the device 20, the user turns the ring nut 22 and then presses the knob 12 as a confirmation of programming; in this case, the device can signal confirmation of programming (for example, acoustically or with a fast flashing of the ring nut) and start-up of the countdown (with flashing of the ring nut that, for example, becomes slower).

Provided hereinafter is a detailed description of at least one preferred modality or rule of operation of the timer system according to the invention. These rules or modalities may be implemented completely or even just in part in the device according to the invention, and may possibly refer to one or more steps of a method of use or control of the device.

1. General Rules or Modalities of Operation

An example of general rules or modalities of operation of the device 20 may be summarized as follows.

1.1) As regards the position of the ring nut 22, as has been said, two angular areas are distinguished: the area (or position) of "mechanical zero" (ring nut 22 turned completely up to the mechanical arrest 40*d*), which generally corresponds to an area of inactivity of the device, and the remaining "active" area (or position) for setting the time of gas supply.

1.2) Once the flame is extinguished, the device 20 remains in a quiescent state.

1.3) Upon ignition of the flame, the device 20 immediately goes into a wait state awaiting a command. In the case where the function of self-extinction referred to previously is envisaged, if the user does not move the ring nut 22 by setting a gas-supply time or by voluntarily disabling the timer, a cycle of automatic timed extinction of the flame starts immediately (with a pre-set time, for example, fifteen seconds). This is advantageous for safety purposes.

1.4) If the timer is disabled, the gas supply to the burner may be carried out in a normal way, without any time limits.

1.5) If the timer is programmed, a cycle of automatic timed extinction of the flame (interruption of the gas supply) starts, with a duration equal to the time set via the ring nut 22.

1.6) According to the type of program loaded in the microcontroller MC, programming may be obtained with different manoeuvres, such as one or more of the following:

- type-1 manoeuvre: the ring nut 22 must be turned keeping the knob 12 of the tap 10 (and hence the pushbutton switch 45) constantly pressed;
- type-2 manoeuvre: the knob 12 of the tap 10 (and hence the pushbutton switch 45) must be pressed just briefly (for example, with release after two seconds) and, for instance at the moment when the emitters 43 start to flash very rapidly, the ring nut 22 must thus be turned within a pre-set time (for example, three seconds); with the ring nut stationary, and for example with emitters 43 again flashing very rapidly, the knob 12 must be pressed again just briefly.

In the manoeuvres of adjustment and/or setting of a time for the device 20, there are preferably envisaged at least two distinct steps or actions, very preferably actions of various nature, in particular, for purposes of greater safety, also in relation to the effective desire of the user to make said adjustment and/or setting. In the example considered here, there are envisaged a step of adjustment and a step of confirmation, such as a time adjustment by turning the ring nut 22 and an action of confirmation by pressing the knob 12.

In the various cases, if the manoeuvre has not been performed correctly or within the required time, the programming operation is cancelled.

1.7) Preferably, it is possible to modify the time of gas supply already set in at least two different modalities (see paragraph 6 below) by modifying the total time irrespective of the time that has already elapsed, or else by prolonging the time set by a length of time specified starting from the time that has already elapsed.

1.8) Before expiry of the time programmed, there is preferably envisaged a "forewarning time" (see paragraph 7 below) within which the user, if he so desires, can re-program a new time before the flame goes out automatically.

1.9) In any circumstance, manual extinction of the flame leads to inactivity of the device 20 (quiescent state).

The visual and acoustic warnings always have a precise and/or predefined meaning in particular in order to identify at least one state and/or operating step of the device according to the invention. For example:

- a light that stays on means that the device 20 is ready to be programmed;
- a slowly flashing light indicates that the device 20 has been programmed and that a cycle of timing or automatic extinction is in progress;
- a rapidly flashing light, preferably together with a suitable acoustic signal (for example, short beeps), indicates that the end of the automatic cycle of extinction is imminent and that the flame will be turned off within a short period (for example, a few seconds);
- an uninterrupted and prolonged acoustic signal (long beeps, for example of the duration of one second) indicates the end of the automatic cycle of extinction;
- in the step of programming of the time, a suitable acoustic signal (for example, a double short beep) may be used to indicate that the device 20 has received a first programming, whereas a different acoustic signal (for example, three short beeps) may be used to indicate reception of a modification of the time previously set.

In the case of a type-2 setting manoeuvre, as mentioned above, a suitable light warning (for example, very fast flashing of the LEDs) may be used to indicate that the device 20 is waiting for the next manoeuvre on the ring nut 22 or on the knob 12 (switch 45), according to the prescribed sequence.

2. Turning-on of the Device

At the moment when the device 20 is initially supplied (for example, upon installation and/or turning-on of the appliance 1, or after a black-out), a characteristic sound warning is emitted, for example:

- five short beeps;
- a number of short beeps depending upon the software version loaded;
- a final long beep.

This generally means that the device 20 has been restored or reset and that it has been re-initialized. In this initialization step, the device 20 extinguishes the flame as a precaution (the safety valve of the tap 10 is forcibly opened, for example, for five seconds), in particular, by opening the switch Q1 for a pre-set time (the time of opening of the switch Q1 in the initialization step may, for example, be set in the firmware). This is done mainly for reasons of safety in the case of malfunctioning such as to bring about a "watchdog" event, with consequent resetting of the device.

3. Ignition of the Flame

When the flame is lit (manually—irrespective of how), the device 20 receives this event (via the circuit FD) and sets itself in a wait state awaiting a command. The user can at this point decide to set a time of supply of gas to the burner, performing a programming manoeuvre as described in the previous paragraph 1 at point 1.6. As has been said, in a possible embodiment, it is possible to activate immediately a cycle of automatic extinction of a pre-set duration. This condition is signalled with suitable acoustic and/or visual warnings (for example, fast flashing and emission of an intermittent and fast acoustic signal—short beeps). In this circumstance, the user is forced to intervene on the device 20 to set the desired time and/or cancel any timer action (see paragraph 5 below).

4. Standard Programming of the Gas-Supply Time

When the device 20 displays a suitable indication (for example, a light warning, such as alight that stays on), it means that it is ready to be programmed. Programming of the cooking time is performed by performing a programming manoeuvre as described in the previous paragraph 1 at point 1.6. The programming operation may establish for example turning-off of the flame after the pre-set time starting from programming; as has been said, it is also possible to perform a second programming before the time has elapsed, which has the different meaning described in paragraph 6 below.

A further signal (for example, a sound signal, such as two fast beeps), indicates that the cycle of automatic extinction of the flame has started, after a time equal to the one programmed.

5. Cancelling of Programming

By bringing the ring nut 22 into a zero position with a programming manoeuvre as described in the previous paragraph 1 at point 1.6, the programming of automatic extinction currently in progress is cancelled. This modification of the operating condition is preferably notified by the device, for example at an acoustic and/or visual level, for instance via a non-flashing light that stays lit up. The device 20 is deactivated, and the gas supply to the burner can proceed for an indefinite time.

6. Modification of the Time Already Set

In the course of a cycle of automatic extinction of the flame that has already started, it is possible to modify the supply time already set. After a first programming, a second programming manoeuvre, as described in the previous paragraph 1 at point 1.6, cancels and substitutes the previous one. In this way, it is possible to set a new desired time before the gas goes out, irrespective of the previous count.

7. Time Scale and Time of Forewarning of End of Supply

The standard time scale obviously depends upon the type of use of the device 20. In the case of cooking appliances, for example, the time scale may range from 0 sec to 60 min. The latter time corresponds to the end-of-travel of the potentiometer 44 (i.e., turned all the way counterclockwise). The use of a burner for a very short period of time usually implies the presence of the user at the cooking appliance so that there is no need for programming: for this reason, it is possible to envisage a minimum programming time, for example of 2 min 30 sec.

In one embodiment, when the time is about to elapse, the device 20 preferably issues an acoustic signal and a visual signal (for example, short beeps and light flashing) in order to notify the user that the flame is about to be turned off. It is of course up to the user to decide whether to reset a new time or not with the modalities described in the previous paragraph 6.

The time of forewarning of end of supply of the gas may depend upon the time initially set via the ring nut; for example,

| Time set | Warning time |
|---|---|
| 0 sec-15 sec | 5 sec |
| 16 sec-30 sec | 7 sec |
| 31 sec-60 sec | 10 sec |
| 61 sec-2 mm 30 sec | 20 sec |
| 2 min 31 sec-5 min | 30 sec |
| 5 min-60 min | 60 sec |

8. Automatic Extinction of the Flame

At the end of time count, the device 20 notifies imminent extinction of the flame, preferably with an acoustic and visual signal. Upon expiry of the time, extinction of the flame takes place (the switch Q1 electrically opens the thermocouple TC-electromagnet EM circuit for a suitable time, for example at least 5 s). This operation is indicated by a suitable signal, for example an acoustic signal, such as two long beeps (1 sec long) spaced apart from one another (for example, by 5 sec). Next, the device 20 sets itself in the quiescent state, maintaining a specific indication, such as a flashing light to indicate that the flame has been turned off by means of the automatic cycle. This indication can then be interrupted by the user, for example by moving the ring nut 22 slightly or bringing it into in the zero position.

9. Manual Extinction of the Flame

At any moment it is possible to turn off the flame manually, for example by closing the tap 10 turning the corresponding knob 12, with the device 20 that enters the quiescent state, interrupting any visual an acoustic warning.

10. Movements of the Ring Nut 22 Outside of a Programming Manoeuvre

If, in the course of a cycle of extinction that has already started, the ring nut 22 is moved inadvertently outside of a setting sequence as described in the previous paragraph 1 at point 1.6 (for example, without confirmation by pressing the knob 12) the device 20 notifies said situation, for example by emitting short beeps, in order to attract the user's attention on this anomalous condition and/or on the fact that the position of the ring nut 22 no longer corresponds to the effective time set.

Figure 28:
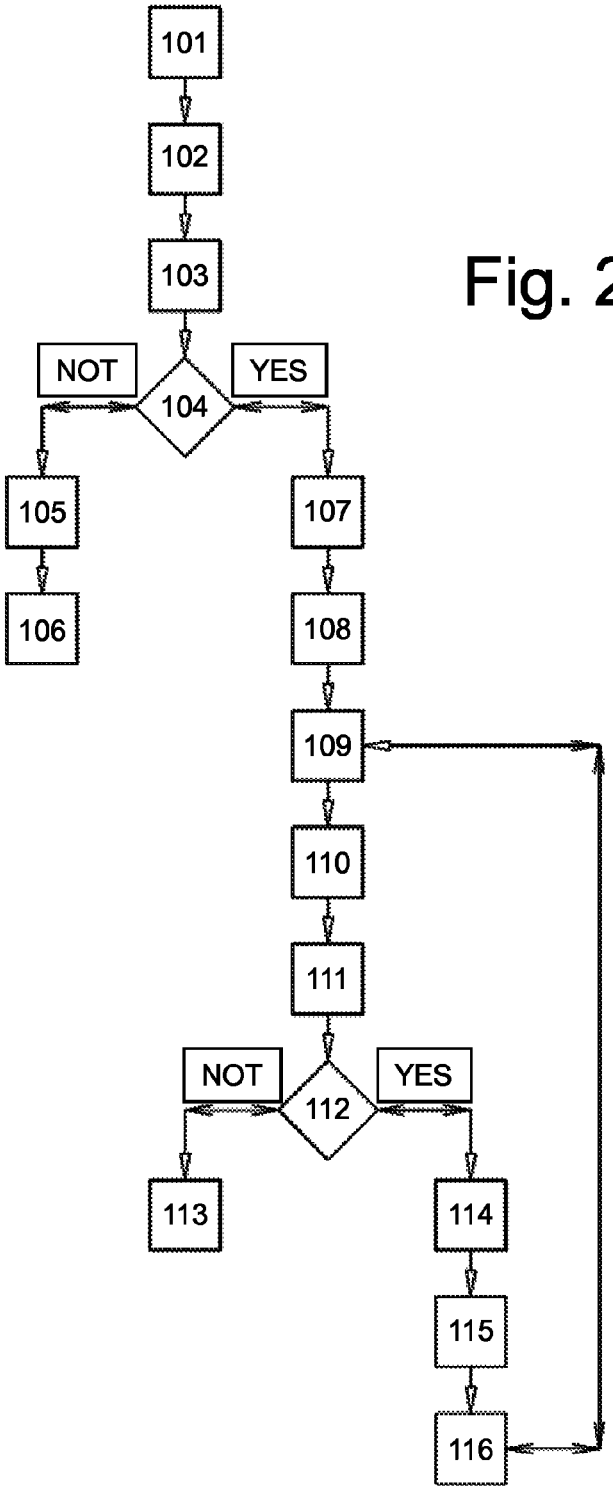
FIG. 28 is a flowchart aimed at exemplifying a possible operating mode of a device according to the invention.

The flowchart of FIG. 28 describes an example of operating logic of the system forming the subject of the invention, in one embodiment thereof.

Block 101 is the starting block and highlights the condition of absence of flame and device 20 not programmed, i.e., in a quiescent state. Block 102 highlights the step of ignition of the burner, which can be obtained by turning and pressing the knob 12 of the tap 10: rotation allows an initial flow of gas to the burner, whereas pressing of the knob determines switching of the switch 45, preferably activating the lighter module IS. Block 103 highlights the condition of flame lit on the burner, following upon which the device 20 activates itself or can be activated in the programming mode. In a possible embodiment, activation in this mode is determined by switching of the switch 45 (block 102), detected by the control circuit of the device 20. In a preferred embodiment, passage to the programming mode is determined by detection of effective ignition of the flame made by the flame-detection circuit FD. Activation in the programming mode is notified to the user, for example via fast flashing of the emitters 43, which can be detected on the ring nut 22. Block 104 is a testing block, in which a check is made to verify whether the user has performed within a given time programming of the device 20, by turning the ring nut 22 beyond the zero position. If he has not (output NO), control passes to block 105, in which the warning mode changes state, for example with the emitters 43 lit up stably, and next to block 106, in which the gas supply to the burner is made to proceed in a normal way, i.e., without a time of forced turning-off being set. If, instead, the user has performed programming (output YES from block 104), control passes to block 107, for detecting the extent of the angular movement of the ring nut 22, and hence of the time set by the user, with corresponding indication. The user then confirms programming (block 108), by pressing the knob 12 of the tap for a short time, this action being detected by the circuit of the device 20 by means switching of the switch 45. Control passes to block 109 for confirmation and indication of the fact that programming is through. The indication may be of an acoustic type, for example via two beeps generated, upon command by the device 20, by the acoustic-warning stage BC of the supply device PSD. Control then passes to block 110, in which the timer circuit MC starts countdown of the time of supply of the burner, preferably with a change of state of the warning light, for example a slow flashing of the emitters 43. Block 111 expresses expiry of the time of forewarning of end of gas supply to the burner, which, as has been explained above, may depend upon the total time set via the ring nut 22. When this forewarning time has elapsed, an acoustic and/or light warning is issued, for example a series of frequent beeps generated by the stage BC upon command by the device 20 and fast flashing of the emitters 43. Control passes then to block 112, which is a testing block, in which a check is made to verify whether the user wishes to prolong the gas supply to the burner, by turning the ring nut 22 (and/or by pressing the knob 12 briefly). If he does not (output NO), control passes to block 113 in which, at the end of the time set via the ring nut 22, the device issues a command for switching the switching means Q1 so as to break the connection between the thermocouple TC and the electromagnet EM, thus extinguishing the flame. Preferably, also a suitable acoustic and/or light warning is issued, for example two prolonged beeps at a distance from one another and a continuous flashing of the emitters. The device 20 is in the quiescent state. In the case where the user prolongs the supply time (output YES from block 112), control passes to block 114, in which a brief pressure exerted on the knob 12 (and/or a rotation of the ring nut 22) is detected. In block 115 an indication notifying activation of the programming mode is issued, such as fast flashing of the emitters 43, and the device remains waiting, for a given time, for further programming confirmation, for example via a short pressure exerted of the knob 12 of the tap, detected in block 116. Control then returns to block 109, for confirming and issuing an indication that reprogramming is through.

FIG. 29 illustrates a variant according to which, in addition or as an alternative to the emitters 43, the circuit arrangement 25 includes at least one emitter 43', associated to which is a stationary light guide LG. In the example, the emitter 43" is directly mounted on the circuit board 25*a* and in a position corresponding to it the lid 41 of the casing defines a positioning seat 41*h* for the light guide LG, which projects or gives out onto on the outside of the casing 21. In this case, the wall 3*a* defines an opening or window 3*b* for viewing the light guide LG. In other variants (not represented) the light guide LG may be absent, with the emitter 43" mounted or configured for projecting directly on the outside of the casing, at a purposely shaped seat 41*h*, possibly associated to which are sealing means, such as a perimetral gasket.

Previously, specific reference has been made to embodiments where the visual-warning means for the user are represented by light emitters, such as LEDs, in particular et within the casing 21 of the device 20 and with a light-guide system designed to transmit light radiation on the outside. In other embodiments, the warning means proper to the device 20 may include a display of alphabetic and/or numeric and/or abstract characters, for example of a LED or LCD type, directly associated to a purposely provided knob for the gas tap. Such a case is schematically exemplified in FIG. 38, where in the knob 12 is housed a display, designated by D. In an embodiment of this sort, of course, the control circuitry exemplified in FIGS. 19 and 21 is prearranged for control of the display D, instead of the emitters 43 and/or 43'. On the other hand, not ruled out is the possibility of providing in one and the same device 20 both a display D and one or more emitters 43 and/or 43' and/or 43". Supply and/or control of the display D may be obtained in wired mode (in which case the knob will be provided with suitable passages for the electrical conductors) or in wireless mode.

It will be appreciated that the logic previously described with reference to the possible warnings issued by the emitters 43 may apply also to the case of use of the display D, where in addition and/or as an alternative to the flashing of characters displayed there may also be envisaged specific wordings and/or symbols of information for the user. In one embodiment, the display D may be used to indicate visually to the user, in a precise way, the programming time while this is being set by turning the ring nut 22 and/or may be used to inform the user, after ignition of the flame, on the residual time and/or on the passage of time of supply of the gas.

For example, in a preferred embodiment, the control logic of the device 20 is configured in such a way that display of the residual time is rendered active after ignition of the burner and programming of a time by the user, for example with a display of a count-down type. In an advantageous embodiment, the control logic is configured for activating a display of the progressive time of cooking if the user lights the burner but does not carry on with programming of the device 20 that equips the corresponding tap, with a display of an incremental type (for such a case, the incremental count of the time can start from detection of the flame, for example obtained via the circuit FD or the electrical signal generated by the thermocouple). Advantageously, the control logic can also be configured in order to enable reset of display of the progressive time, starting off a new progressive count (for example, by applying a brief pressure on the knob 12). In these embodiments, the active condition of the display D evidently represents also the condition of ignition of the flame on the burner.

It is clear that numerous variations may be made by a person skilled in the art to the device described by way of example, without thereby departing from the scope of the invention as defined in the annexed claims. The various characteristics of the various examples may be combined at least in part together to form devices that may even be different from the ones represented and described by way of non-limiting example herein.

In the embodiments previously exemplified, associated to one and the same control element 45 are both activation of the lighter system and the functions of the device 20 associated to timing, but it is clear that even more than one control element, such as two separate contacts or switches may provided. In such a variant, for example, the control element associated to timing may be switched via the ring nut 22, which in this case will be mounted axially movable. As already mentioned, moreover, the device 20 may not perform functions linked to ignition of the burner.

Previously, reference has been made to the use of control means, amongst which the switch Q1, designed to modify the state of the electrical connection between the electrical-connection means 47 and 25*d*, i.e., to open the thermocouple-solenoid electrical circuit when the time interval set via the ring nut 22 has elapsed. As already mentioned, according to possible variants, the control means may be prearranged for modifying the state of the connection referred to above, without necessarily opening the aforesaid circuit, but simply by varying it (for example, by inserting in parallel to the thermocouple a load or a resistance that reduces the current to the solenoid).

As already mentioned, in addition or as an alternative to the sound warning, the supply device PSD may include a display circuit, interfaced to a suitable display device, in particular designed to represent numeric and/or alphabetic and/or abstract characters in order to perform both functions similar to the ones previously described with reference to the warning-circuit device BC, and functions of representation of information generated, by the individual circuit arrangements 25 of the devices 20.

As an alternative to what has been explained previously, the devices 20 and PSD could comprise even just some of the parts or functions described above.

The invention claimed is:

1. A gas appliance control device for a gas appliance having a body, at least one gas burner and at least one gas tap for controlling admission of gas to the at least one gas burner, the at least one gas tap having a safety valve that includes an electromagnet to be supplied with an electric current generated by thermo-electric generator, wherein the control device comprises a circuit arrangement, which includes at least one first control circuit, and at least one control module having a supporting structure, configured to be associated to the at least one gas tap within the body of the gas appliance, the supporting structure defining a housing contained within which is said at least one first control circuit, wherein:

the at least one control module comprises command means operable by a user for activating at least one of a timing function and a function of ignition of the at least one gas burner, and the at least one first control circuit comprises control means, first electrical-interconnection means, and detection means configured for detecting actuation of the command means and supplying corresponding signals to the control means, wherein the circuit arrangement further comprises an auxiliary module designed for installation on the body of the gas appliance in a position remote from the supporting structure of the at least one control module and the corresponding gas tap, wherein the auxiliary module has a centralized circuit which is electrically connected to the at least one first control circuit or the at least one control module and which comprises:

second electrical-interconnection mean, for connection of the centralized circuit between an AC electrical mains and the at least one first control circuit of the at least one control module, and a supply circuit for low-voltage DC supply of the at least one first control circuit of the at least one control module.

2. The device according to claim 1, wherein the centralized circuit comprises at least one of:

a power circuit, configured for governing an AC-supplied gas-lighter circuit; and a signaling circuit, configured for notifying operating conditions of the at least one control module;

the at least one of the power circuit and the signaling circuit being controllable via control signals generated by the at least one first control circuit.

3. The device according to claim 2, wherein the first electrical-interconnection means comprise first connector means of the at least one first control circuit and the second electrical-interconnection means comprise second connector means of the centralized circuit, wherein the first connector means and the second connector means are electrically connected by a multi-conductor wiring including;

at least two conductors for low-voltage supply of the at least one first control circuit by the low-voltage DC supply circuit of the centralized circuit, and at least one conductor for driving the at least one of the signaling circuit and the power circuit of the centralized circuit.

4. The device according to claim 2, wherein the centralized circuit comprises said signaling circuit, wherein the at least one control module comprises a local signaling circuit, and wherein the at least one first control circuit is arranged for driving the local signaling circuit of the at least one control module separately from the signaling circuit of the centralized circuit.

5. The device according to claim 2, wherein the control signals are low-voltage signals.

6. The device according to claim 2, wherein the signaling circuit is an acoustic signaling circuit.

7. The device according to claim 2, wherein:

the centralized circuit comprises said power circuit, the at least one first control circuit comprises a switch operable by a user for causing operation of said AC-supplied gas-lighter circuit, the power circuit of the centralized circuit comprises an electronic switch, switching of the switch of the at least one first control circuit generates a control signal for causing switching of the electronic switch of the power circuit of the centralized circuit, and switching of the electronic switch of the power circuit of the centralized circuit causes operation of the AC-supplied gas-lighter circuit.

8. The device according to claim 1, wherein the first electrical-interconnection means comprise first connector means, configured for connection to said electromagnet, and second connector means, configured for connection to said thermo-eletric generator, and wherein:

the detection means of the at least one first control circuit comprise first detection means configured for detecting actuation of the command means and supplying corresponding signals to the control means; and the control means are configured for changing the state of an electrical connection between the first connector means and the second connector means upon expiry of a time interval set via the command means.

9. The device according to claim 8, wherein the at least one first control circuit comprises an electronic switch electrically connected in a circuit between the first connector means and the second connector means, the control means of the at least one first control circuit are prearranged for controlling the electronic switch upon expiry of a time interval set via the command means, to cause opening of said circuit between the first connector means and the second connector means, the control means of the at least one first control circuit are also configured for imposing, before expiry of said time interval, millisecond-scale openings of the electronic switch, and the at least one first control circuit includes a flame-detecting circuit, which is prearranged for detecting, following each said millisecond-scale opening of the electronic switch, possible voltage variations or over-voltages in said circuit between the first connector means and the second connector means, to deduce thereby presence of a flame at the gas burner.

10. The device according to claim 1, wherein the circuit arrangement comprises at least one of:

visual-warning means and a driving circuit of said visual-warning means, the visual-warning means and the corresponding driving circuit being implemented in the at least one first control circuit; and acoustic-warning means, implemented in the centralized circuit.

11. The device according to claim 1, wherein said at least one first control circuit comprises a plurality of first control circuits and said at least one control module comprises a plurality of control modules, each first control circuit of said plurality of first control circuits being housed in the supporting structure of a corresponding control module of said plurality of control modules, the auxiliary control module being designed for installation on the body of the gas appliance in a position remote from the supporting structures of the control modules of said plurality of control modules, the centralized circuit being designed to be electrically connected to the first control circuits of said plurality of first control circuits.

12. The device according to claim 11, wherein the centralized circuit comprises a signaling circuit, configured for issuing warnings representing operating conditions of any control module of said plurality of control modules, the signaling circuit of the centralized circuit being controllable via control signals generated by any one of the first control circuits of said plurality of first control circuits, and wherein the circuit arrangement implements a control protocol to establish sequence and/or mode with which different warnings, corresponding to different control signals generated in a same time interval by two o more first control circuits of said plurality of control circuits, have to be issued by the signaling circuit of the centralized circuit.

13. The device according to claim 11, wherein the centralized circuit comprises at least one of a power circuit, configured for governing an AC-supplied gas-lighter circuit, and a signaling circuit, configured for notifying operating conditions of the at least one control module, and wherein each first control circuit of said plurality of control circuits is connected to the centralized circuit via a multi-conductor wiring comprising:

at least two conductors for low-voltage supply of each first control circuit of said plurality of first control circuits by the supply circuit of the centralized circuit, at least one conductor for driving, by any one of the first control circuits of said plurality of first control circuits, of the at least one of the power circuit and the signaling circuit of the centralized circuit.

14. A gas appliance, comprising a control device according to claim 1.

15. The device according to claim 1, wherein the at least one first control circuit comprise a controller and a voltage-adjustment circuit, the voltage-adjustment circuit being prearranged to generate, starting from a voltage supplied by the supply circuit of the centralized circuit, a lower voltage for supplying the controller.

16. A gas appliance control device for a gas appliance having a body, a plurality of gas burners and a plurality of gas taps, each gas tap controlling admission of gas to a gas burner, each gas tap comprising a safety valve that includes an electromagnet to be supplied with an electric current generated by a corresponding thermo-electric generator, wherein the control device comprises a circuit arrangement including a plurality of first control circuits, and a plurality of control modules each having a supporting structure, configured to be associated to a corresponding gas tap within the body of the gas appliance, the supporting structure housing a corresponding first control circuit of said plurality of first control circuits, wherein each control module comprises a command means operable by a user for activating at least one of a timing function and a function of ignition of the gas burner controlling admission of gas to the respective gas tap, wherein each first control circuit comprises control means, first electrical-interconnection means, and detection means configured for detecting actuation of the command means and supplying corresponding signals to the control means, wherein the circuit arrangement further comprises a centralized module designed for installation on the body of the gas appliance in a position remote from the supporting structures of the control modules and the corresponding gas taps, wherein the centralized module has a centralized circuit which is electrically connected to the first control circuits of said plurality of control circuits and which comprises:

second electrical-interconnection means, for connection of the centralized circuit between an AC electrical mains and the first control circuits of said plurality of control circuits; and a supply circuit for low-voltage DC supply of the first control circuits of said plurality of control circuits.

17. The device according to claim 16, wherein the centralized circuit moreover comprises at least one of:

a power circuit, configured for governing an AC-supplied gas-lighter circuit having respective electrodes at each gas burner of the plurality of gas burners, and a signaling circuit, configured for issuing warnings representing operating conditions of each control module of the plurality of control modules, wherein the at least one of the power circuit and the signaling circuit of the centralized circuit is controllable via control signals generated by any one of the first control circuit of said plurality of control circuits.

18. The device according to claim 17, wherein the centralized circuit comprises said signaling circuit, which is configured for issuing warnings representing operating conditions of any control module of said plurality of control modules, the signaling circuit of the centralized circuit being controllable via control signals generated by any one of the first control circuits of said plurality of first control circuits, and wherein the circuit arrangement implements a control protocol to establish sequence and/or mode with which different warnings, corresponding to different control signals generated in a same time interval by two o more first control circuits of said plurality of control circuits, have to be issued by the signaling circuit of the centralized circuit.

19. The device according to claim 16, wherein the first electrical-interconnection means of each first control circuit of said plurality of control circuits comprise first connector means, configured for connection to said electromagnet, and a second connector means, configured for connection to said thermo-electric generator, each first control circuit of said plurality of control circuits comprises an electronic switch electrically connected in a circuit between the corresponding first connector means and second connector means, the control means of each first control circuit of said plurality of control circuits are prearranged for controlling the corresponding electronic switch upon expiry of a time interval set via the command means, to cause opening of said circuit between the first connector means and the second connector means, the control means of each first control circuit of said plurality of control circuits are also configured for imposing, before expiry of said time interval, millisecond-scale openings of the corresponding electronic switch, and each first control circuit of said plurality of control circuits comprises a flame-detecting circuit prearranged for detecting, following each said millisecond-scale opening of the electronic switch, possible voltage variations or over-voltages in said circuit between the first connector means and the second connector means, to deduce thereby presence of a flame at a corresponding gas burner.

20. The device according to claim 17, wherein the centralized circuit comprises said signaling circuit, wherein each control module of said plurality of control modules comprises a local signaling circuit, and wherein each first control circuits of the plurality of control circuits is arranged for driving the local signaling circuit of corresponding control module of said plurality of control modules separately from the signaling circuit of the centralized circuit.

* * * * *